US009653026B2

(12) United States Patent
Tatsumi

(10) Patent No.: US 9,653,026 B2
(45) Date of Patent: May 16, 2017

(54) BACKLIGHT CONTROLLING APPARATUS, BACKLIGHT CONTROLLING METHOD AND PROGRAM

(71) Applicant: CANON KABUSHIKI KAISHA, Tokyo (JP)

(72) Inventor: Eisaku Tatsumi, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 92 days.

(21) Appl. No.: 13/783,690

(22) Filed: Mar. 4, 2013

(65) Prior Publication Data

US 2013/0234922 A1 Sep. 12, 2013

(30) Foreign Application Priority Data

Mar. 7, 2012 (JP) ..... 2012-050586
Mar. 7, 2012 (JP) ..... 2012-050792

(51) Int. Cl.
*G09G 3/34* (2006.01)

(52) U.S. Cl.
CPC ..... *G09G 3/3406* (2013.01); *G09G 2310/024* (2013.01); *G09G 2320/0247* (2013.01); *G09G 2320/0261* (2013.01); *G09G 2320/0646* (2013.01); *G09G 2340/0435* (2013.01)

(58) Field of Classification Search
CPC ..... G09G 3/3406; G09G 2340/0435; G09G 2320/0646; G09G 2320/0261; G09G 2320/0247; G09G 2310/024; G09G 3/20; G09G 3/34; G09G 3/36; G09G 2320/062; G09G 2320/0626; G09G 3/2022; G09G 3/2025; G02F 1/133; G02F 1/1336
See application file for complete search history.

(56) References Cited

U.S. PATENT DOCUMENTS 8,284,218 B2 * 10/2012 Yoshida ..... G09G 3/2025 345/204
9,071,800 B2 * 6/2015 Ikawa ..... H04N 5/58
2008/0068359 A1 * 3/2008 Yoshida et al. ..... 345/204
(Continued)

FOREIGN PATENT DOCUMENTS

CN 1711576 A 12/2005
CN 1918619 A 2/2007
CN 101543064 A 9/2009
(Continued)

OTHER PUBLICATIONS

Japanese Office Action issued in corresponding application No. 2012050586 on Jan. 5, 2016.
(Continued)

*Primary Examiner* — Jennifer Mehmood
*Assistant Examiner* — Sardis F Azongha
(74) *Attorney, Agent, or Firm* — Carter, DeLuca, Farrell & Schmidt, LLP

(57) ABSTRACT

A timing controller performs control to cause a backlight to emit light at first brightness for a first time in a period that original image data is displayed on a liquid crystal panel, and cause the backlight to emit light at second brightness darker than the first brightness for a second time longer than the first time in a period that intermediate image data generated based on the original image data is displayed on the liquid crystal panel.

17 Claims, 12 Drawing Sheets

(56) References Cited

U.S. PATENT DOCUMENTS

| | | | | |
|---|---|---|---|---|
| 2009/0009455 | A1* | 1/2009 | Kimura | G09G 3/2074 345/89 |
| 2009/0289968 | A1* | 11/2009 | Yoshida | 345/691 |

FOREIGN PATENT DOCUMENTS

| | | | |
|---|---|---|---|
| CN | 101715114 | A | 5/2010 |
| JP | H11-202285 | A | 7/1999 |
| JP | 2002-215111 | A | 7/2002 |
| JP | 2005-266751 | A | 9/2005 |
| JP | 2006-235461 | A | 9/2006 |
| JP | 2007-133220 | A | 5/2007 |
| JP | 2008-070838 | A | 3/2008 |
| JP | 2008-076644 | A | 4/2008 |
| JP | 2008-083457 | A | 4/2008 |
| JP | 2009-251069 | A | 10/2009 |
| JP | 2011-217370 | A | 10/2011 |
| KR | 2002-0020180 | A | 3/2002 |
| WO | 2006-103746 | A1 | 10/2006 |
| WO | 2010/126103 | A1 | 11/2010 |

OTHER PUBLICATIONS

Japanese Office Action issued in corresponding application No. 2012050792 on Jan. 5, 2016.

Korean Office Action issued in corresponding application No. 10-2013-0023954 on Dec. 29, 2014.

Japanese office action issued in corresponding application No. 2012050792 on May 24, 2016.

Chinese Office Action issued in corresponding application No. 201310073314.X on Oct. 29, 2014.

Japanese office action issued in corresponding Japanese application No. 2012050586 on Aug. 9, 2016.

Japanese refusal issued in corresponding application No. 2012050586 on Mar. 7, 2017.

* cited by examiner

FIRST CURRENT SETTING VALUE
31
SECOND CURRENT SETTING VALUE
32
ANALOG SELECTOR
33
ANALOG SWITCH ARRAY
34
DRIVER
35
LED
36
LIGHT GUIDE PANEL
38
LED
37
INPUT OF IMAGE SIGNAL
IMAGE QUALITY ADJUSTING CIRCUIT
21
FRAME FREQUENCY CONVERTING CIRCUIT
22
FRAME MEMORY
23
TIMING CONTROLLER
24
SOURCE DRIVER
25
GATE DRIVER
26
LIQUID CRYSTAL PANEL
27

BACKLIGHT CONTROLLING APPARATUS, BACKLIGHT CONTROLLING METHOD AND PROGRAM

BACKGROUND OF THE INVENTION

Field of the Invention

The present invention relates to a technique of controlling a backlight to be used in a displaying apparatus displaying image data.

Description of the Related Art

Conventionally, when original image data and intermediate image data are alternately displayed at same luminance on a liquid crystal displaying apparatus, a portion in which the intermediate image data has been disturbed stands out because the intermediate image data is not data which has been created completely. To cope with such inconvenience, Japanese Patent Application Laid-Open No. 2008-070838 discloses the technique in which light for original image data is emitted brightly and light for intermediate image data is emitted darkly, whereby a portion in which the intermediate image data has been disturbed does not so stand out. Besides, Japanese Patent Application Laid-Open No. 2008-0083457 discloses the technique in which light emission is performed so as to display original image data long time and display intermediate image data short time.

In addition, as one of conventional displaying methods, there is a method of holding a display while continuously causing a backlight to emit light. However, when holding the display, a moving image is viewed blurrily. Consequently, an apparatus such as a television set or the like of displaying moving images includes a type of controlling light emission of a backlight. For example, a technique which is called black insertion has been generally known. In this technique, if it intends to sharpen the moving image by prolonging a black insertion time, there is a problem that a flicker occurs when the moving image is displayed based on short light emission at 60 Hz. Therefore, when displaying the moving image by performing the light emission twice for a short time in one frame to prevent the occurrence of the flicker, there is a problem that the moving image is viewed doubly.

On the other hand, Japanese Patent Application Laid-Open No. 2002-215111 discloses the technique of controlling to prolong a light emission time of a backlight in conformity with necessary luminance. Further, Japanese Patent Application Laid-Open No. 2009-251069 discloses the technique of controlling to prolong a light emission time of a backlight in a period portion which is close to the center, in conformity with necessary luminance.

However, in addition to the problem of the disturbance of the intermediate image data, there is the problem of the occurrence of the flicker. As in the above related art, since the flicker occurs when the image is displayed in two kinds of states, i.e., brightly and darkly, the flicker becomes strong when a contrast between light and darkness is made large, whereby it becomes difficult for a viewer to easily view the displayed image. For this reason, there is a limit in enlarging the contrast between light and darkness. Moreover, a phenomenon in which the surrounding area of a displayed object visually flickers occurs due to a difference between the waveforms of the original image data and the intermediate image data. Furthermore, when emitting light for a long time to brighten the intermediate image data, there is another problem. That is, in the displayed portion which is moving, even though the intermediate image data is generated, the generated image is viewed like an image which trails. Such a phenomenon in which the image trails is called moving image blurring.

In consideration of such conventional drawbacks as described above, an object of the present invention is to perform a high-quality image display.

SUMMARY OF THE INVENTION

A backlight controlling apparatus according to the present invention, which controls a backlight used in a displaying apparatus for displaying image data, is characterized by comprising: a controlling unit configured to perform control to cause the backlight to emit light at first brightness for a first time in a period that original image data is displayed on the displaying apparatus, and cause the backlight to emit light at second brightness darker than the first brightness for a second time longer than the first time in a period that intermediate image data generated based on the original image data is displayed on the displaying apparatus.

Besides, a backlight controlling apparatus according to the present invention, which controls a backlight used in a displaying apparatus for displaying image data, is characterized by comprising: a controlling unit configured to perform control to cause the backlight to emit light at first brightness for a first time and cause the backlight to emit light at second brightness darker than the first brightness for a second time longer than the first time, in a period that the image data of one frame is displayed on the displaying apparatus.

Further features of the present invention will become apparent from the following description of exemplary embodiments with reference to the attached drawings.

DESCRIPTION OF THE EMBODIMENTS

Hereinafter, the exemplary embodiments of the present invention will be described with reference to the attached drawings.

First Embodiment

First, how various images are viewed will be exemplarily described with reference to FIGS. 1A to 1E. More specifically, FIG. 1A illustrates how the image displayed by impulse light emission at 60 Hz is viewed, FIG. 1B illustrates how the image displayed by holding a backlight and performing black insertion at 60 Hz is viewed, FIG. 1C illustrates how the image displayed by holding the backlight and giving light and darkness at 120 Hz is viewed, FIG. 1D illustrates how the image displayed by performing impulse light emission of the backlight and giving light and darkness at 120 Hz is viewed, and FIG. 1E illustrates how the image displayed by causing the backlight to emit light at 120 Hz is viewed in the first embodiment of the present invention.

In FIGS. 1A to 1E, it is assumed that an object (or a body) which is displayed on a liquid crystal panel is spherical and is moved from right to left for each frame. The vertical axis in each of FIGS. 1A to 1E indicates a time, and, in case of a display at 60 Hz, image data is changed every 16.67 ms. Incidentally, in each of FIGS. 1A to 1E, movement of eyes is indicated by the arrow. Here, image data (that is, image data which can be viewed by a viewer) which is obtained by synthesizing the objects along the movement of the eyes is shown in the lowest portion of each drawing.

Figure 1A:
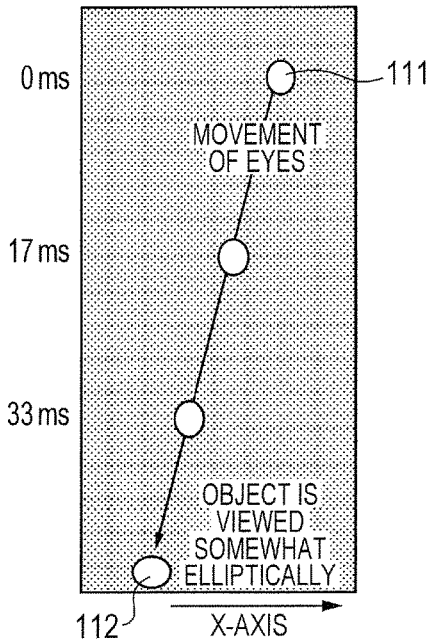
FIGS. 1A, 1B, 1C, 1D and 1E are diagrams for describing how various images are viewed.
Figure 1B:
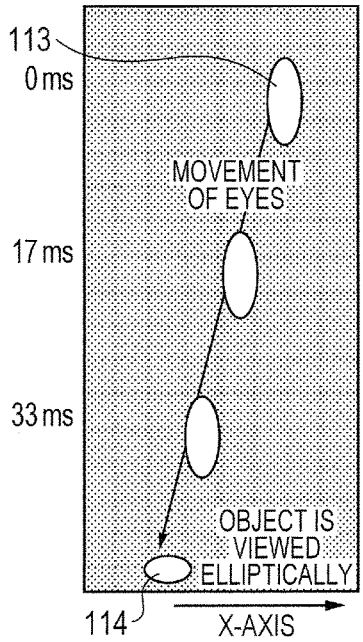
Figure 1C:
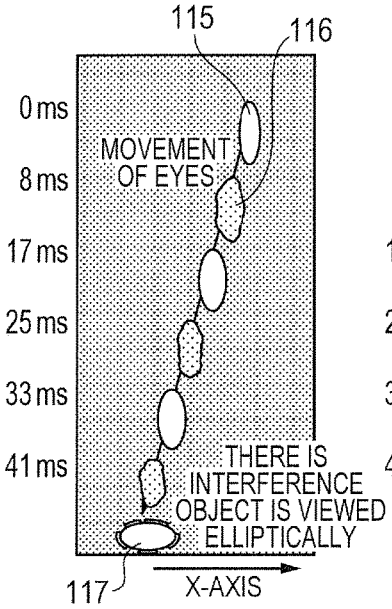
Figure 1D:
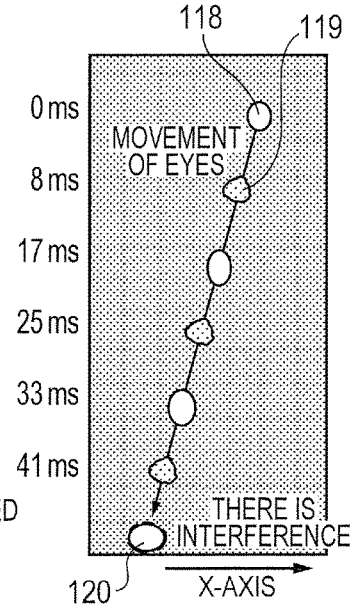
Figure 1E:
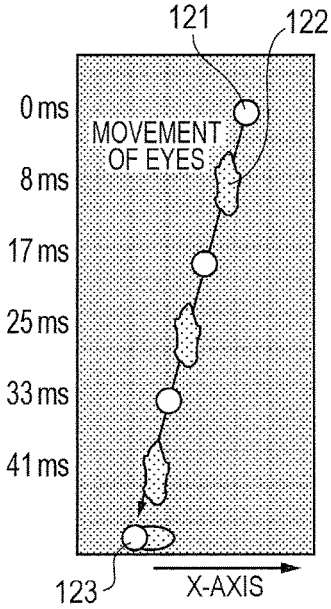

FIG. 1A shows a shape 111 of the object which is viewed within one frame by impulse light emission, and a shape 112 of the object which is viewed by synthesizing several frames by impulse light emission. FIG. 1B shows a shape 113 of the object which is viewed within one frame by hold light emission, and a shape 114 of the object which is viewed by synthesizing several frames by hold light emission. FIG. 1C shows a shape 115 of the object which is viewed within a frame of original image data by hold bright light emission (i.e., light emission to be performed brightly), a shape 116 of the object which is viewed within a frame of intermediate image data by hold dark light emission (i.e., light emission to be performed darkly), and a shape 117 of the object which is viewed by synthesizing several frames by hold light emission. FIG. 1D shows a shape 118 of the object which is viewed within a frame of original image data by impulse bright light emission, a shape 119 of the object which is viewed within a frame of intermediate image data by impulse dark light emission, and a shape 120 of the object which is viewed by synthesizing several frames by impulse light emission. FIG. 1E shows a shape 121 of the object which is viewed within a frame of original image data by impulse bright light emission according to the present embodiment, a shape 122 of the object which is viewed within a frame of intermediate image data by hold dark light emission according to the present embodiment, and a shape 123 of the object which is viewed by synthesizing several frames by light emission according to the present embodiment.

In the example illustrated in FIG. 1A, since only original image data is displayed for each frame by the impulse light emission, the object is viewed spherically as indicated by the shape 111, and the object obtained by synthesizing the several frames is viewed somewhat elliptically but such an ellipse is close to a sphere, whereby the moving object is viewed most excellently. However, when the object image is displayed by the impulse light emission at 60 Hz, a flicker seriously occurs, whereby the object cannot be displayed brightly.

In the example illustrated in FIG. 1B, since only original image data is displayed for each frame by the hold light emission, the light emission time is long as indicated by the shape 113. When several shapes like this are synthesized in the movement direction of the eyes, the object to be viewed is modified elliptically as indicated by the shape 114. Since the hold light emission time is shortened to half, the degree of ellipticity is not so serious, but the fact remains that the shape of the object is deformed elliptically. If the black insertion time is more prolonged, the degree of ellipticity can be suppressed. However, if doing so, since the original image data is resultingly displayed not by the hold light emission but by the impulse light emission, a flicker seriously occurs as well as the example illustrated in FIG. 1A.

In consideration of such a drawback, the example of generating and displaying the intermediate image data at 120 Hz to prevent occurrence of the flicker will be described hereinafter. In the example illustrated in FIG. 1C, the shape 115 of the object based on the original image data is viewed by the hold bright light emission, and the shape 116 of the object based on the intermediate image data is viewed by the hold dark light emission. Here, the shape 116 is a distorted ellipse due to an error in generation of the intermediate image data. The shape 117 of the object is viewed by synthesizing the above shapes in conformity with the movement of the eyes, and the surrounding of the viewed shape 117 is flickered because the ellipses and the distorted ellipses are alternately displayed.

In the example illustrated in FIG. 1D, the impulse light emission is performed so that the object can be viewed spherically. That is, in FIG. 1D, the shape 118 of the object based on the original image data is viewed by the impulse bright light emission, and the viewed shape is close to a sphere because the light emission is the impulse light emission. Further, the shape 119 of the object based on the intermediate image data is viewed by the impulse dark light emission. Here, the shape 119 is a distorted ellipse due to an error in generation of the intermediate image data. The shape 120 of the object, which is viewed by synthesizing the above shapes in conformity with the movement of the eyes, is close to a sphere. However, the surrounding of the viewed shape 120 is likewise flickered because of a conversion error of the intermediate image data.

FIG. 1E exemplarily shows how the object is viewed, according to the present embodiment. That is, in the example illustrated in FIG. 1E, the shape 121 of the object based on the original image data is viewed by the impulse bright light emission, and the viewed shape is close to a sphere because the light emission is the impulse light emission. Further, the shape 122 of the object based on the intermediate image data is viewed by the hold dark light emission. Here, the shape 122 is a distorted ellipse due to an error in generation of the intermediate image data. The shape 123 of the object is viewed by synthesizing the above shapes in conformity with the movement of the eyes.

In the above synthesized shape, the distorted ellipse is linked to the bright spherical image. That is, the shape same as the moving shape is viewed brightly, and the dark image like a trail is viewed so as to be linked to the bright shape. The shape 123 which is viewed like this is different from the shapes 114 and 117 which have been modified, and is different also from the shapes 117 and 120 of which the surroundings are flickered. Although the dark trail is viewed in the shape 123, this trail is natural as the movement of the object to be viewed on the displaying apparatus and thus can be easily accepted by a viewer.

Figure 2:
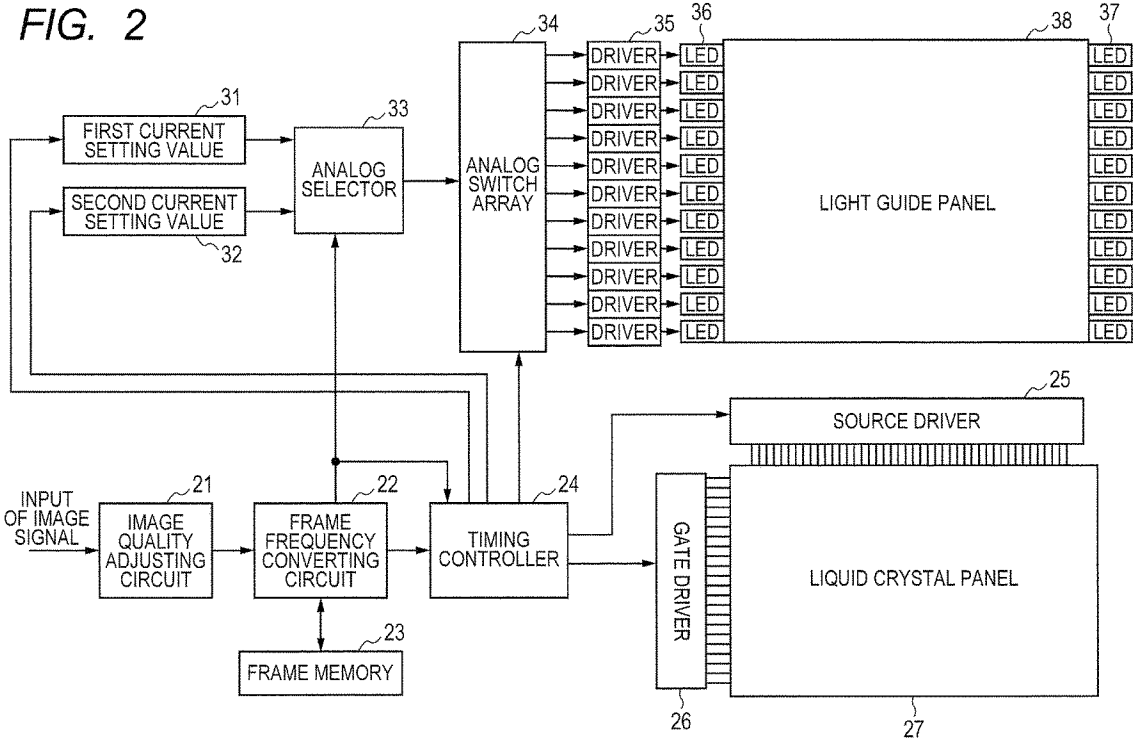
FIG. 2 is a block diagram illustrating a constitution of a displaying apparatus according to an embodiment of the present invention.

FIG. 2 is a block diagram illustrating a constitution of the displaying apparatus according to the first embodiment of the present invention. Here, it should be noted that a backlight in which a backlight scanning operation using an LED is carried out is applied to the displaying apparatus in the present embodiment. Incidentally, the displaying apparatus according to the present embodiment has the constitution to which a backlight controlling apparatus is exemplarily applied.

In FIG. 2, an image quality adjusting circuit 21 adjusts image quality of an image signal (image data) according to the displaying apparatus and/or viewer's setting, a frame frequency converting circuit 22 creates intermediate image data of one or more frames between frames of original image data, a frame memory 23 temporarily stores therein frame image data, a timing controller 24 controls and adjusts timing of a panel module and a backlight module, a source driver 25 drives a liquid crystal panel 27, and also a gate driver 26 drives the liquid crystal panel 27.

A first current setting value 31 is used to determine a current when causing the LED to emit light brightly, and a second current setting value 32 is used to determine a current when causing the LED to emit light darkly. Further, an analog selector 33 switches between the first current setting value and the second current setting value, an analog switch array 34 switches between ON and OFF of each LED, drivers (LED drivers) 35 drive corresponding LEDs respectively, LEDs 36 are arranged up and down on the left, LEDs 37 are arranged up and down on the right, and a light guide panel 38 streakily guides rays of light of the left LEDs and rays of light of the right LEDs.

Subsequently, an outline of an operation to be performed by the displaying apparatus according to the present embodiment will be described. First, the image quality adjusting circuit 21 outputs RGB signals corresponding to an optimum image, by performing image quality adjusting to an input image signal (YPbPr signals) with use of the characteristic of the liquid crystal panel 27 and viewer's preference as parameters.

Then, the frame frequency converting circuit 22 generates, with use of the frame memory 23 as a temporary storage, the intermediate image data by known vector inference from the original image data of two frames. Incidentally, the intermediate image data is generated once between the two frames when the frequency is raised from 60 Hz to 120 Hz. Further, if the frequency is raised to 240 Hz, three intermediate image data are resultingly generated between the two frames.

Next, the RGB signals of which the frequency has been raised to 120 Hz are input to the timing controller 24. At the same time, also a signal indicating whether the input RGB signals are the signals of the original image data or the signals of the intermediate image data is input to the timing controller 24.

Next, the timing controller 24 transfers, to the source driver 25 of the liquid crystal panel 27, gradation data which is obtained by converting the RGB signals into digital values indicating voltages, and also transfers, to the gate driver 26 thereof, a timing signal by which a scanning operation is performed at 60 Hz. Thus, the source electrodes and the gate electrodes of the liquid crystal panel 27 are driven respectively by the source driver and the gate driver, and also not-illustrated common electrodes are driven together, whereby the image data is displayed on the screen of the liquid crystal panel.

Subsequently, an operation of the backlight module in the displaying apparatus according to the present embodiment will be described. That is, the timing controller 24 outputs the voltage values respectively corresponding to the first current setting value 31 and the second current setting value 32, by using an internal DA (digital-to-analog) converter. For example, when the current values of the LEDs 36 and 37 at the time of the bright light emission are 20 mA, the first current setting value 31 is set to 2V. On the other hand, when the current values thereof at the time of the dark light emission are 4 mA, the second current setting value 32 is set to 0.4V.

The frame frequency converting circuit 22 outputs a signal indicating which of the original image data and the intermediate image data is being output. The analog selector 33 receives the relevant signal from the frame frequency converting circuit 22, switches between the first current setting value 31 and the second current setting value 32, and then outputs the switched value. In the present embodiment, the first current setting value is output during the period that the original image data is being displayed, and the second current setting value is output during the period that the intermediate image data is being displayed.

The timing controller 24 controls the scanning operation to the analog switch array 34. Here, it should be noted that the scanning operation is the operation which controls to shift the operation of switching ON to OFF from the upper analog switch to the lower analog switch, on the basis of the output value of the analog selector 33. Further, the timing controller 24 controls to make the time for maintaining each analog switch with ON different between the original image data and the intermediate image data. In other words, the ON time for the original image data is shortened, while the ON time for the intermediate image data is prolonged.

Each current setting value which has been ON/OFF controlled by the analog switch array 34 is converted into a current value (20 mA or 4 mA) by the LED driver 35, and the converted current value is supplied to the left LED 36 and the right LED 37. Each of the left LED 36 and the right LED 37 to which the current was supplied emits bright light or dark light in accordance with the supplied current value (20 mA or 4 mA). Then, since the rays of light from the left LEDs 36 and the right LEDs 37 are guided by the light guide panel 38 lateral-streakily, the front surface of the light guide panel 38 lights up zonally. Thus, the liquid crystal panel 27 emits light in such a manner that the image on the liquid crystal panel 27 is scanned by the backlight.

Figure 3A:
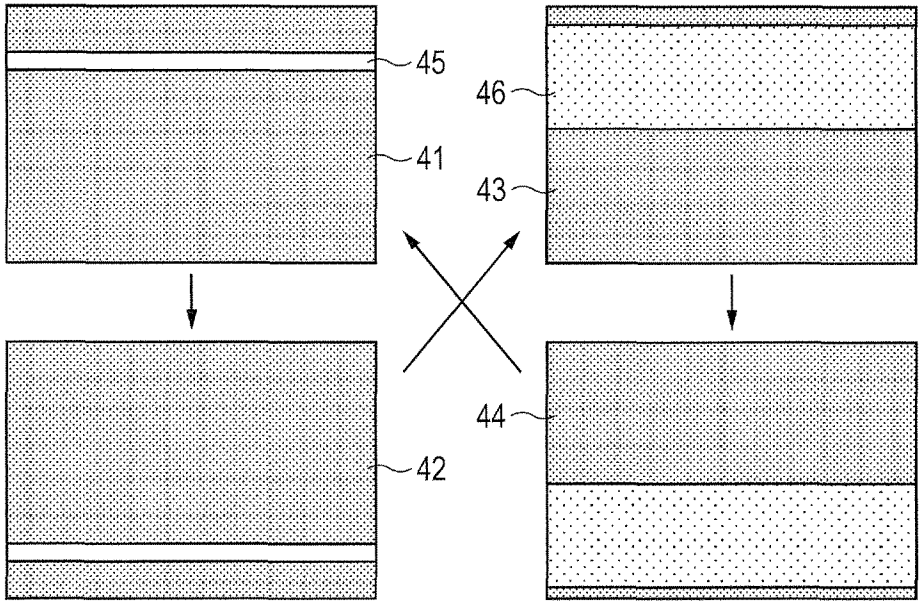
FIGS. 3A and 3B are diagrams illustrating light emission states of a backlight according to a first embodiment of the present invention.
Figure 3B:
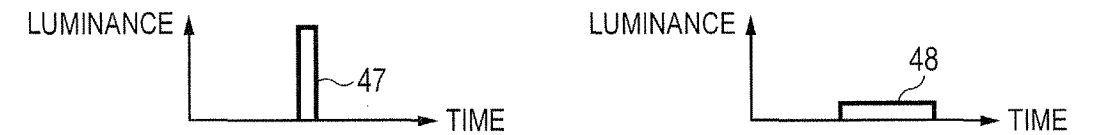

FIGS. 3A and 3B are diagrams illustrating light emission states of the backlight according to the present embodiment. More specifically, FIG. 3A shows a situation that the light emission state transitions as time passes, and FIG. 3B shows a relation between the time and the luminance on the line near the center.

In FIG. 3A, a state 41 is a backlight state for displaying the first half of the original image data, a state 42 is a backlight state for displaying the second half of the original image data, a state 43 is a backlight state for displaying the first half of the intermediate image data, and a state 44 is a backlight state for displaying the second half of the intermediate image data. Light emission 45 is bright light emission for a short time, and light emission 46 is dark light emission for a long time. In FIG. 3B, a numeral 47 indicates a luminance change which occurs on the line near the center when displaying the original image data, and a numeral 48 indicates a luminance change which occurs on the line near the center when displaying the intermediate image data. Incidentally, it should be noted that the light emission 45 corresponds to an example that light is emitted at first brightness for a first time, and the light emission 46 corresponds to an example that the light is emitted at second brightness darker than the first brightness for a second time longer than the first time.

In FIG. 3A, the backlight state repetitively transitions from the state 41 to the state 42, from the state 42 to the state 43, from the state 43 to the state 44, and from the state 44 to the state 41. At this time, the bright short-time light emission 45 performs the scan from top to bottom, and subsequently the dark long-time light emission 46 performs the scan from top to bottom. This operation is repeatedly performed.

Then, relations between the backlight states and the liquid crystal panel will be described hereinafter. Namely, the time of displaying the original image data corresponds to the portion from the state just before the state 41 to the state just after the state 42, and the relevant time is equivalent to the time during which a bright thin line scans from top to bottom. Further, the time of displaying the intermediate image data corresponds to the portion from the state just before the state 46 to the state just after the state 47, and the relevant time is equivalent to the time during which a dark thick line scans from top to bottom.

If it pays attention to a certain line, as indicated by the numeral 47, it causes the backlight to emit light at high luminance for a short time in case of displaying the original image data. On the other hand, as indicated by the numeral 48, it causes the backlight to emit light at low luminance for a long time in case of displaying the intermediate image data. In any case, the moving object as illustrated in FIG. 1E can be viewed by combining such light emission patterns of the backlight with the displaying states of the original image data and the intermediate image data on the liquid crystal panel 27.

Figure 4:
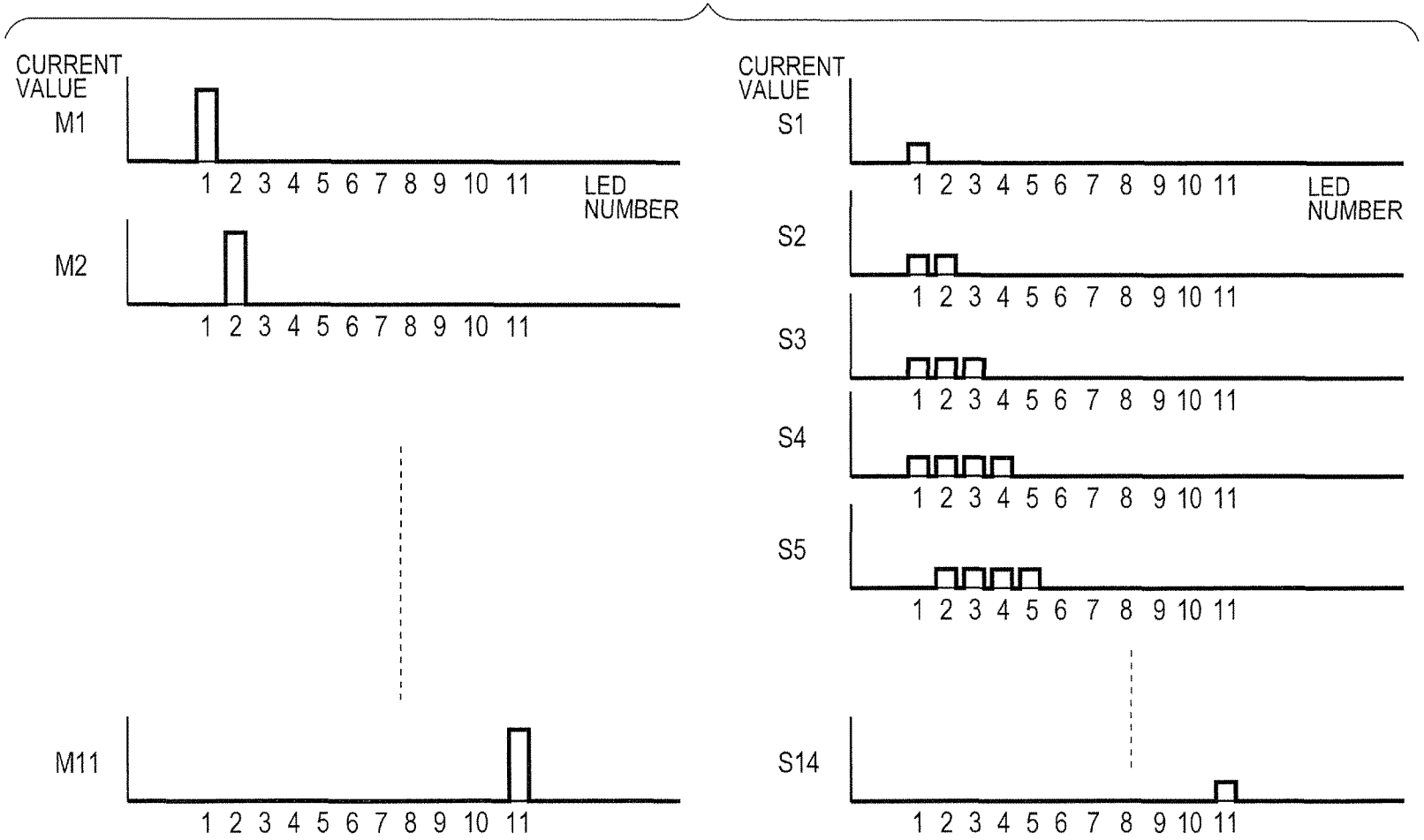
FIG. 4 is a diagram illustrating situations of currents flowing in LEDs (light emitting diodes).

FIG. 4 is a diagram illustrating situations of the currents flowing in the LEDs 36 and 37. Here, it should be noted that the LED numbers of the LEDs 36 and 37 from top to bottom (from 1 to 11) are allocated on the horizontal axes in FIG. 4. Here, although the number of each set of the LEDs 36 and 37 is set to 11 for simplifying the description, the number of the LEDs can be made larger when the backlight having a large screen is used. Incidentally, the vertical axes indicate current values.

The currents flowing in the LEDs 36 and 37 transition as indicated by states M1, M2 to M11, S1, S2 to S14 in this order as time passes. There is a pause period between the states M11 and S1 and there is also a pause period between the states S14 and M1. Thus, if the image signal of 60 Hz is used, one period corresponds to 16.67 ms, and each state is about 0.6 ms. Incidentally, it should be noted that the original image data is displayed in the states M1 to M11, and the intermediate image data is displayed in the states S1 to S14.

In the state M1, it is controlled to cause the uppermost LED (1) to emit light brightly. When the state transitions to the state M2, it is controlled to cause the LED (1) to turn off light and cause the LED (2) to emit light brightly. Then, the states sequentially transition from top to bottom so as to scan the screen, and it is controlled in the state M11 to cause the lowermost LED (11) to emit light brightly. In the subsequent pause period, all the LEDs are being turned off.

In the state S1, it is controlled to cause the uppermost LED (1) to emit light darkly. When the state transitions to the state S2, it is controlled to cause the LED (2) to emit light darkly as causing the LED (1) to emit light. Then, the states sequentially transition to the state S3 and further to the state S4 while increasing the number of the LEDs being emitting light. Then, in the state S5, it is controlled to cause the LED (1) to turn off light and cause the LED (5) to emit light darkly. Likewise, the state sequentially transitions to the state S6 and the subsequent states so as to cause the one LED to emit light and the one LED to turn off light in each state. After then, in the state S14, only the lowermost LED is emitting light. In the subsequent pause period, all the LEDs are being turned off. Thus, it is possible by controlling the current values and the ON times of the LEDs to obtain the light emission patterns of the backlight as illustrated in FIGS. 3A and 3B.

Incidentally, it is necessary to set the phase of the center of the light emission period of the original image data and the phase of the center of the light emission period of the intermediate image data to be substantially the same in each frame. This is because, if these phases shift from each other, the components of the period of 60 Hz increase totally in despite of the period of 120 Hz, whereby a flicker occurs.

It should be noted that the present invention is not limited to the above embodiment, and can be established in another embodiment of which the factors are the same as those of the above embodiment. For example, it is desirable from the aspect of the flicker to set the luminance of the original image data and the luminance of the intermediate image data to be the same. Here, it should be noted that the luminance in this case implies a luminance value which is obtained by integrating pulse-like repetitive light emissions by a long time.

With respect to the range in which a light emission intensity of the LED is proportional to the current value, the luminance of the original image data and the luminance of the intermediate image data come to be the same if the current value for the intermediate image data in the first embodiment is changed from 4 mA to 5 mA. Alternatively, the luminance of the original image data and the luminance of the intermediate image data come to be approximately the same if a light emission time of the intermediate image data is set to be five times as much as a light emission time of the original image data.

"luminance of original image data":"luminance of intermediate image data"=1:1

However, it is desirable to lower the luminance of the intermediate image data within the flicker acceptable range, because the trail is reduced in this range. Although such a luminance ratio as described above changes according to display luminance, it roughly satisfies the following range.

"luminance of original image data":"luminance of intermediate image data"=1:1→4:1

Namely, the luminance of the intermediate image data is more than a quarter of the luminance of the original image data.

Further, since a cost of the LED increases if it causes the LED to emit light brightly for a short time, it is desirable to lower the luminance of the original image data than the luminance of the intermediate image data for the purpose of reducing the cost. Therefore, it is practical if the luminance ratio satisfies the following range.

"luminance of original image data":"luminance of intermediate image data"=1:1→1:2

Namely, the luminance of the intermediate image data is twice or less as much as the luminance of the original image data.

Next, the number of the frames of the intermediate image data need not be the same as the number of the frames of the original image data. Although it is desirable to increase the number of the frames of the intermediate image data for the purpose of a more smooth display, the intermediate image data of the moving object is viewed blurrily. For this reason, since the trails increase if the number of the frames of the intermediate image data is large, it is important not to increase the number of the frames of the intermediate image data unnecessarily. Therefore, it is practical if the number of the frames satisfies the following range.

"the number of frames of original image data":"the number of frames of intermediate image data"=1:1→1:3

Next, with respect to the backlight, the scanning manner which is performed by the LEDs arranged right and left is described in the first embodiment. However, it is of course possible to use a scanning manner which is performed by a direct-beneath LED backlight. Here, if the direct-beneath LED backlight is used, since it is possible to change a luminance distribution of the image data by independently controlling each LED block according to the luminance distribution, whereby a dynamic contrast improves. In this case, both the light emission intensity for the original image data and the light emission intensity for the intermediate image data are controlled for each LED.

Incidentally, the present invention is not limited to the above scanning manner. That is, the present invention is also applicable to, as well as the scanning manner, a manner of causing the whole surface of the backlight to simultaneously emit light by simultaneously blinking the whole surface. In case of applying the present invention to this manner, it only has to control, as well as the first embodiment, the light quantity and the time for causing the whole surface of the backlight to emit light. More specifically, it causes the whole surface to emit light brightly for a short time when displaying the original image data, and to emit light darkly for a long time when displaying the intermediate image data.

Second Embodiment

Subsequently, the second embodiment of the present invention will be described. In the second embodiment, it will be described an operation of causing a device such as an LED for performing intermittent light emission to emit light for intermediate image data with a small duty cycle. Incidentally, the constitution of a displaying apparatus according to the second embodiment is the same as that of the displaying apparatus according to the first embodiment illustrated in FIG. 2. Hereinafter, only points different from the first embodiment will be described.

Figure 5A:
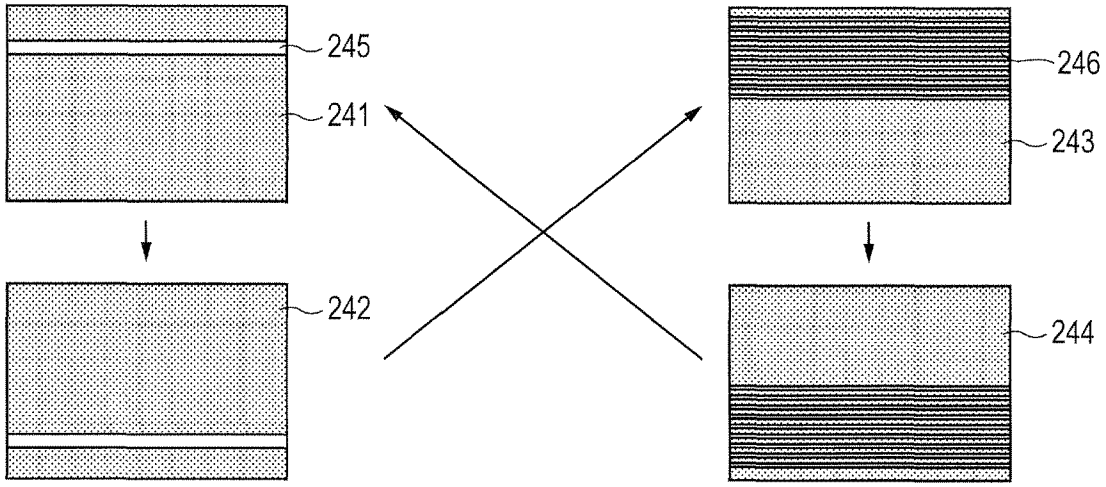
FIGS. 5A, 5B and 5C are diagrams for describing a backlight scanning operation according to a second embodiment of the present invention.
Figure 5B:
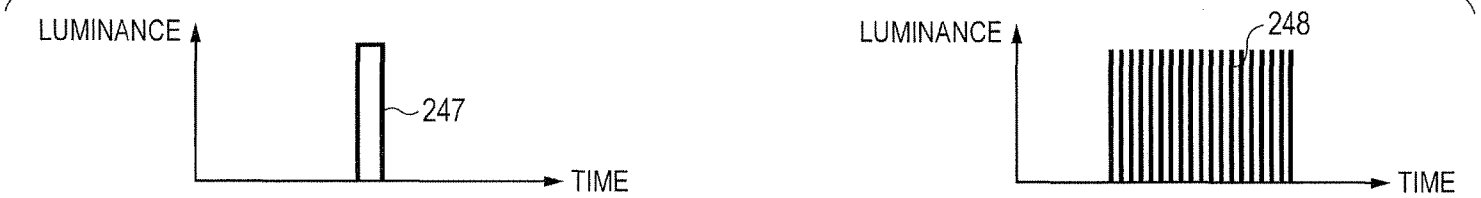
Figure 5C:
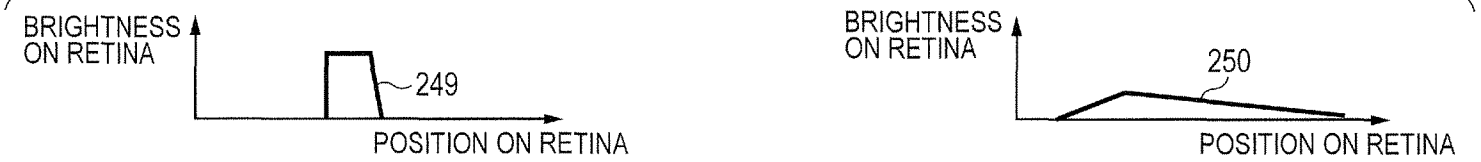

FIGS. 5A to 5C are diagrams for describing a backlight scanning operation according to the second embodiment of the present invention. More specifically, FIG. 5A shows a situation that the light emission state transitions as time passes, FIG. 5B shows a relation between the time and the luminance on the line near the center, and FIG. 5C shows a relation between a position on a viewer's retina and brightness viewed.

In FIG. 5A, a state 241 is a backlight state for displaying the first half of the original image data, a state 242 is a backlight state for displaying the second half of the original image data, a state 243 is a backlight state for displaying the first half of the intermediate image data, and a state 244 is a backlight state for displaying the second half of the intermediate image data. Light emission 245 is bright light emission for a short time, and light emission 246 is bright numerous light emissions. In FIG. 5B, a numeral 247 indicates a luminance change which occurs on the line near the center when displaying the original image data, and a numeral 248 indicates a luminance change which occurs on the line near the center when displaying the intermediate image data. In FIG. 5C, numeral 249 indicates a distribution of projected brightness on a retina when the original image data is displayed, and numeral 250 indicates a distribution of projected brightness on a retina when the intermediate image data is displayed.

In FIG. 5A, the backlight state repetitively transitions from the state 241 to the state 242, from the state 242 to the state 243, from the state 243 to the state 244, and from the state 244 to the state 241. At this time, the bright short-time light emission 245 performs the scan from top to bottom, and subsequently the bright numerous light emissions 246 perform the scan from top to bottom.

Then, relations between the backlight states and the liquid crystal panel will be described hereinafter. Namely, the period of displaying the original image data corresponds to the period from the state just before the state 241 to the state just after the state 242, and the relevant period is equivalent to the period during which a bright thin line scans from top to bottom. Further, the period of displaying the intermediate image data corresponds to the period from the state just before the state 246 to the state just after the state 247, and the relevant period is equivalent to the period during which a plurality of bright thin lines scan from top to bottom.

If it pays attention to a certain line, as indicated by the numeral 247, it causes the backlight to emit light at high luminance for a short time in case of displaying the original image data. Meanwhile, it causes the backlight to emit light at the same luminance numerous times for a very short time in case of displaying the intermediate image data. When a viewer follows with his/her eyes an object which is moving right and left, the pixel of the object on the liquid crystal panel 27 is viewed as if the pixel is flowing on the viewer's retina. When the light emission is impulse light emission such as the light emission 245, the pixel flashes for only a moment. Thus, the pixel is viewed only at the position on the viewer's retina at which this pixel at this time is reflected, as indicated by the distribution 249. When the light emission is plural-time light emissions such as the bright numerous light emissions 246, there are the plurality of the positions of the pixels at this time, the pixels are averaged and thus viewed so as to be spread as indicated by the distribution 250.

In any case, the moving object as illustrated in FIG. 1E can be viewed by combining such light emission patterns of the backlight with the displaying states of the original image data and the intermediate image data on the liquid crystal panel 27.

In the second embodiment, it is possible, without controlling a light emission intensity of the LED, to achieve the same effect as that achieved when controlling the light emission intensity, by extremely reducing a duty cycle of the light emission when displaying the intermediate image data, even if performing a control only in a time direction. Likewise, even if it causes the backlight to emit light intermittently with a high duty cycle when displaying the original image data, it is possible to achieve the same effect because the displayed image is averaged visually.

Third Embodiment

Subsequently, the third embodiment of the present invention will be described. In the third embodiment, a case of performing light emission by using a lamp such as a CCFL (Cold Cathode Fluorescent Lamp) for which it is difficult to control brightness will be described. Incidentally, the constitution of a displaying apparatus according to the third embodiment is the same as that of the displaying apparatus according to the first embodiment illustrated in FIG. 2. Hereinafter, only points different from the first embodiment will be described.

Figures 6A, 6B, 6C, 6D:
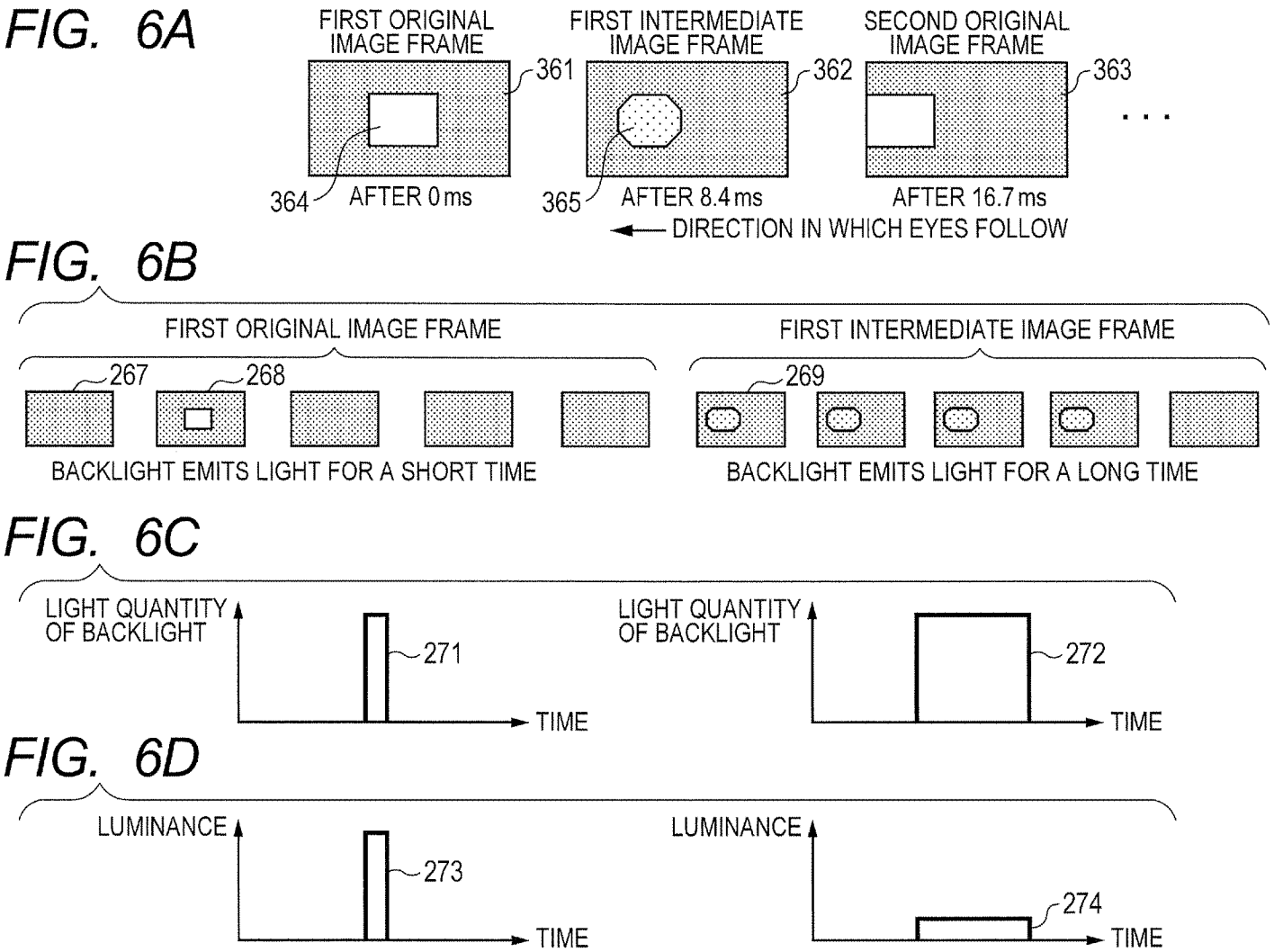
FIGS. 6A, 6B, 6C and 6D are diagrams for describing an operation in which control of light and darkness of images and control of a light emission time of a backlight are combined, according to a third embodiment of the present invention.

FIGS. 6A to 6D are diagrams for describing an operation in which control of light and darkness of images and control of a light emission time of a backlight are combined, according to the third embodiment of the present invention. More specifically, FIG. 6A shows a light emission state transitions on the single body of a liquid crystal panel 27, FIG. 6B shows a light emission state obtained by coupling backlights, FIG. 6C shows a relation between a lapse of time and a light quantity of the backlight, and FIG. 6D shows a relation between a lapse of time and luminance of light emission display.

In FIG. 6A, a frame 361 is a first frame of original image data, a frame 362 is a first frame of intermediate image data, a frame 363 is a second frame of the original image data, an object 364 is a moving object in the original image data, and an object 365 is a moving object in the intermediate image data. In FIG. 6B, a state 267 is a light emission displaying state in a case where the backlight is turned off, a state 268 is a light emission displaying state in a case where the backlight emits light for a short time, and a state 269 is a light emission displaying state in a case where the backlight emits light for a long time. In FIG. 6C, a numeral 271 indicates a lapse of time of a light quantity of the backlight in case of displaying the original image data, a numeral 272 indicates a lapse of time of a light quantity of the backlight in case of displaying the intermediate image data, a numeral 273 indicates a lapse of time of luminance in case of displaying the original image data, and a numeral 274 indicates a lapse of time of luminance in case of displaying the intermediate image data.

As indicated by the moving object 365 illustrated in FIG. 6A, the gradation of the intermediate image data has been set to be lower than that of the original image data in a frame frequency converting circuit 22. As indicated by the numerals 271 and 272 illustrated in FIG. 6C, it causes the backlight to emit light in an even light quantity without dark and light. Thus, as indicated by the state 268, it causes the backlight to emit light brightly for a short time for the original image data in the period indicated by the numeral 271, whereby the lapse of time is given as indicated by the numeral 273. Besides, as indicated by the state 269, it causes the backlight to emit light darkly for a long time for the intermediate image data in the period indicated by the numeral 272, whereby the lapse of time is given as indicated by the numeral 274. Thus, since the characteristic same as that indicated in FIG. 1 can be resultingly obtained, the present embodiment is applicable even to the backlight for which the light quantity cannot be adjusted.

In the present embodiment, when the moving image is displayed, the original image data of which the image quality is excellent is viewed as an image for which moving image blurring is small, and the intermediate image data of which the image quality is poor is viewed as blurrily. Therefore, when the original image data and the intermediate image data are coupled and then viewed, it is possible to obtain the moving image display which is sharp and has less interference. Moreover, since the brightness of the intermediate image data can be set to be close to the brightness of the original image data, it is possible to restrain occurrence of a flicker. Since the intermediate image data is correctly generated, it is of course possible in still image data to perform high-quality image display.

Fourth Embodiment

Subsequently, the fourth embodiment of the present invention will be described. First, how various images are viewed will be exemplarily described with reference to FIGS. 7A to 7E. More specifically, FIG. 7A illustrates how the image displayed by performing impulse light emission of a backlight at 60 Hz is viewed, FIG. 7B illustrates how the image displayed by holding the backlight and performing black insertion at 60 Hz is viewed, FIG. 7C illustrates how the image displayed by two-step lighting display of holding the backlight and giving light and darkness is viewed, FIG. 7D illustrates how the image displayed by two-time lighting display of performing impulse light emission of the backlight is viewed, and FIG. 7E illustrates how the image displayed by two-step lighting display of the backlight is viewed in the embodiment of the present invention.

In FIGS. 7A to 7E, it is assumed that an object (or a body) which is displayed on a liquid crystal panel is spherical and is moved from right to left for each frame. The vertical axis in each of FIGS. 7A to 7E indicates a time, and, in case of a display at 60 Hz, an image is changed every 16.67 ms. Incidentally, in each of FIGS. 7A to 7E, movement of eyes is indicated by the arrow. Here, the image (that is, the image which can be viewed by a viewer) which is obtained by synthesizing the objects along the movement of the eyes is shown in the lowest portion of each drawing.

Figure 7A:
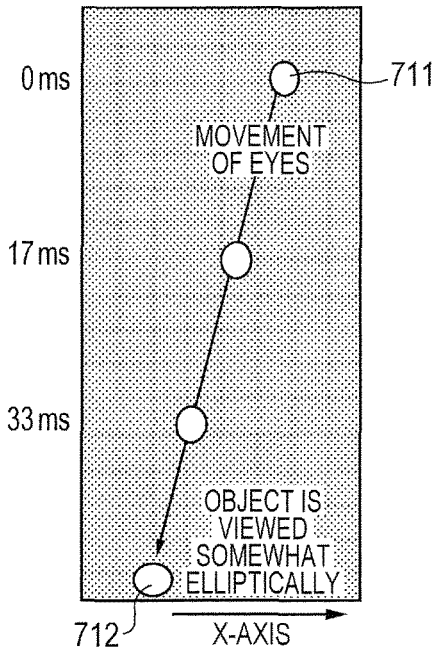
FIGS. 7A, 7B, 7C, 7D and 7E are diagrams for describing how various images are viewed.
Figure 7B:
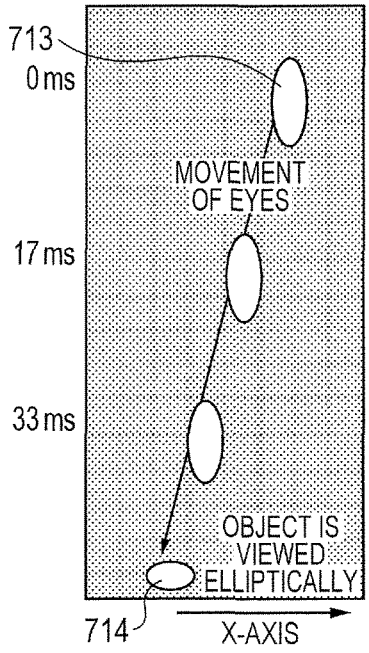
Figure 7C:
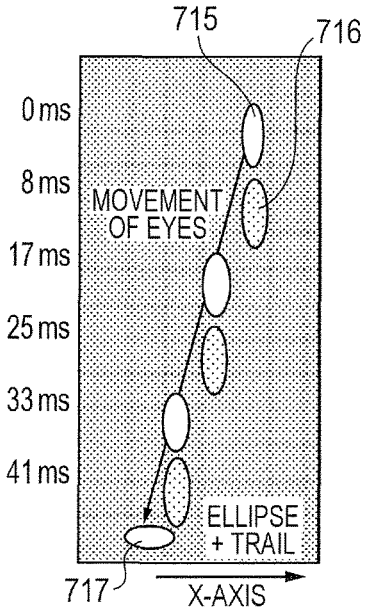
Figure 7D:
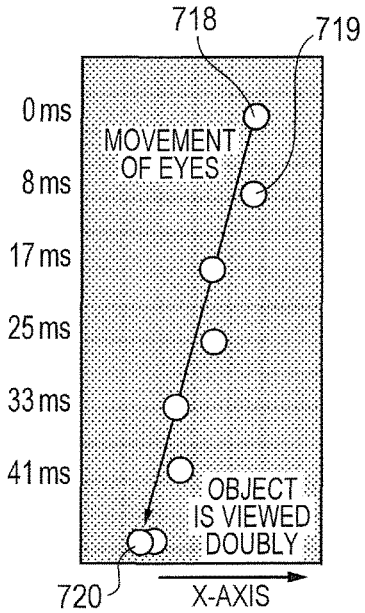
Figure 7E:
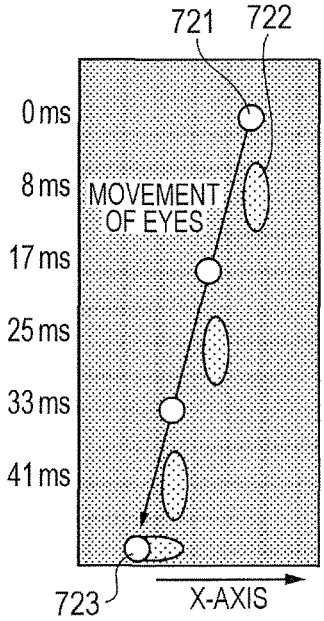

FIG. 7A shows a shape 711 of the object which is viewed within one frame by impulse light emission, and a shape 712 of the object which is viewed by synthesizing several frames by impulse light emission. FIG. 7B shows a shape 713 of the object which is viewed within one frame by hold light emission, and a shape 714 of the object which is viewed by synthesizing several frames by hold light emission. FIG. 7C shows a shape 715 of the object which is viewed within one frame by hold bright light emission (i.e., light emission to be performed brightly), a shape 716 of the object which is viewed within one frame by hold dark light emission (i.e., light emission to be performed darkly), and a shape 717 of the object which is viewed by synthesizing several frames by hold light emission. FIG. 7D shows a shape 718 of the object which is viewed within one frame by impulse first light emission, a shape 719 of the object which is viewed within one frame by impulse second light emission, and a shape 720 of the object which is viewed by synthesizing several frames by impulse light emission. FIG. 7E shows a shape 721 of the object which is viewed within one frame by impulse bright light emission according to the present embodiment, a shape 722 of the object which is viewed within one frame by hold dark light emission according to the present embodiment, and a shape 723 of the object which is viewed by synthesizing several frames by light emission according to the present embodiment.

In the example illustrated in FIG. 7A, since the object is displayed for a first light emission period for each frame by the impulse light emission, the object is viewed spherically as indicated by the shape 711, and the object obtained by synthesizing the several frames is viewed somewhat elliptically but such an ellipse is close to a sphere as indicated by the shape 712, whereby the moving object is viewed most excellently. However, when the object is displayed by the impulse light emission at 60 Hz, a flicker seriously occurs, whereby the object cannot be displayed brightly.

In the example illustrated in FIG. 7B, the object is displayed for the first light emission period for each frame by the hold light emission. In this case, since the light emission is the hold light emission, the light emission time is long as indicated by the shape 713. When several shapes like this are synthesized in the movement direction of the eyes, the object to be viewed is modified elliptically as indicated by the shape 714. Since the hold light emission time is shortened to half by means of the black insertion, the degree of ellipticity is not so serious, but the fact remains that the shape of the object is deformed elliptically. If the black insertion time is more prolonged, the degree of ellipticity can be suppressed. However, if doing so, since the object is resultingly displayed not by the hold light emission but by the impulse light emission, a flicker seriously occurs as well as the example illustrated in FIG. 7A.

In consideration of such a drawback, the example of displaying the object by performing the light emission display twice within one frame to prevent occurrence of the flicker will be described hereinafter. In the example illustrated in FIG. 7C, the shape 715 of the object is viewed by the hold bright light emission for the first light emission period, the shape 716 of the object is viewed by the hold dark light emission for a second light emission period, and the shape 717 of the object is viewed by synthesizing the above shapes in conformity with the movement of the eyes. In the shape 717, the bright ellipse and the dark ellipse such as the trail are viewed by the viewer.

In the example illustrated in FIG. 7D, the impulse light emission is performed so that the object can be viewed spherically. That is, in FIG. 7D, the shape 718 of the object is viewed by the first impulse light emission, and the viewed shape is close to a sphere because the light emission is the impulse light emission. Although the shape of the object which is viewed by the second impulse light emission is also a sphere, as indicated by the shape 719, this shape is gone from the movement of the eyes because it is displayed behind time. The shape of the object viewed by synthesizing them in conformity with the movement of the eyes is the shape obtained by doubling the spheres as indicated by the shape 720. This is called double blurring, and such a visibility is poor in terms of image quality.

FIG. 7E exemplarily shows how the object is viewed, according to the present embodiment. That is, in the example illustrated in FIG. 7E, the shape 721 of the object is viewed by the first impulse bright light emission, and the viewed shape is close to a sphere because the light emission is the impulse light emission. Besides, the shape 722 of the object is viewed by the second hold dark light emission, and this shape is a dark ellipse. The shape 723 of the object is viewed by synthesizing the above shapes in conformity with the movement of the eyes.

In the above synthesized shape, the dark elliptic image is linked to the bright spherical image. That is, the shape same as the moving shape is viewed brightly, and the dark image like the trail is viewed behind so as to be linked to the bright shape. The shape 723 is different from the shapes 714 and 717 which have been modified, and is not viewed doubly unlike the shape 720. Although the dark trail is viewed, this trail is natural as the movement of the object to be viewed on the displaying apparatus and thus can be easily accepted by the viewer.

Figure 8:
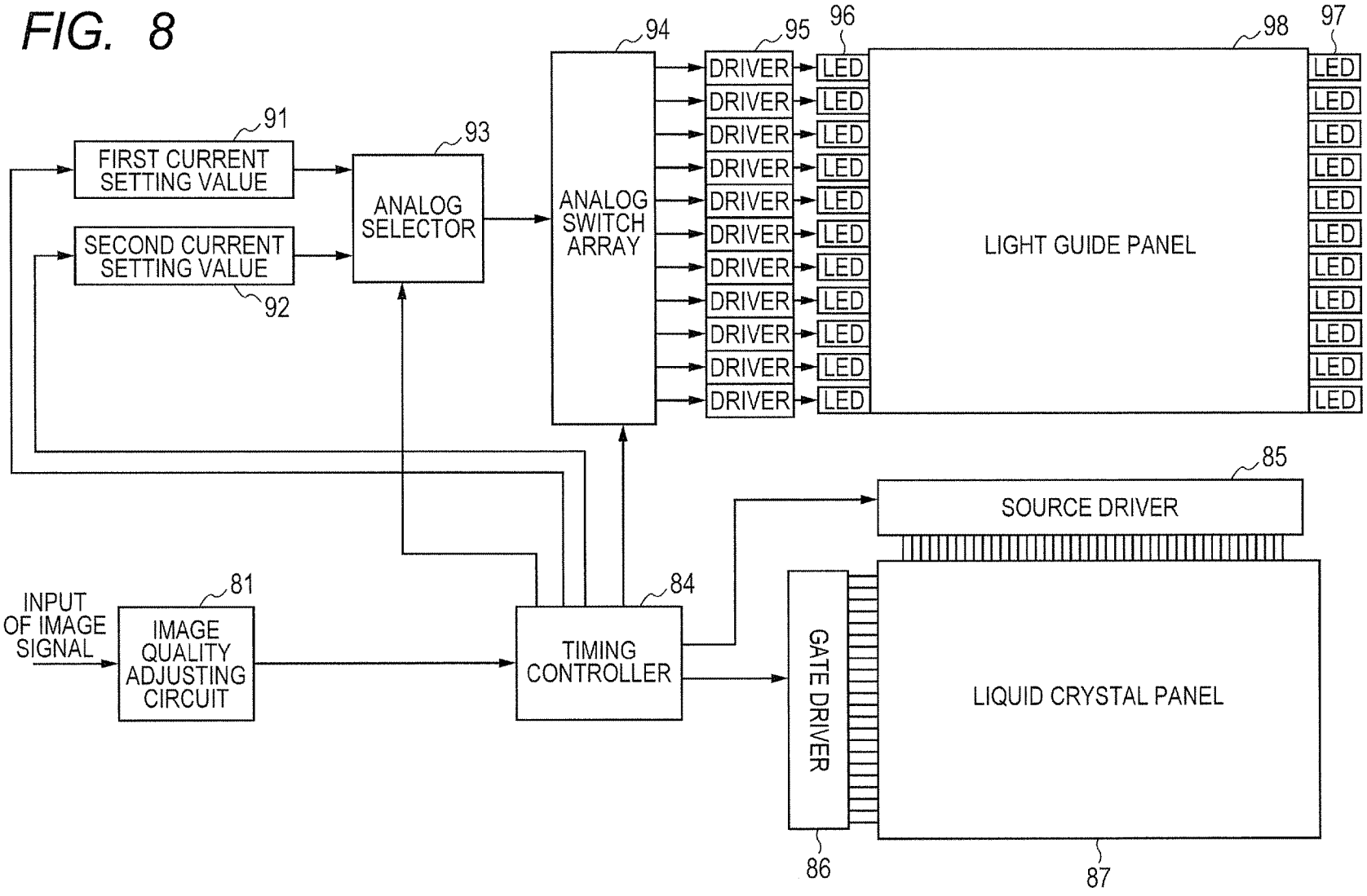
FIG. 8 is a block diagram illustrating a constitution of a displaying apparatus according to a fourth embodiment of the present invention.

FIG. 8 is a block diagram illustrating a constitution of the displaying apparatus according to the fourth embodiment of the present invention. Here, it should be noted that a backlight in which a backlight scanning operation using an LED is carried out is applied to the displaying apparatus in the present embodiment. Incidentally, the displaying apparatus according to the present embodiment has the constitution to which a backlight controlling apparatus is exemplarily applied.

In FIG. 8, an image quality adjusting circuit 81 adjusts image quality of an image signal (image data) according to the displaying apparatus and/or viewer's setting, a timing controller 84 controls and adjusts timing of a panel module and a backlight module, a source driver 85 drives a liquid crystal panel 87, and also a gate driver 86 drives the liquid crystal panel 87.

A first current setting value 91 is used to determine a current when causing the LED to emit light brightly, and a second current setting value 92 is used to determine a current when causing the LED to emit light darkly. Further, an analog selector 93 switches between the first current setting value and the second current setting value, an analog switch array 94 switches between ON and OFF of each LED, drivers (LED drivers) 95 drive corresponding LEDs respectively, LEDs 96 are arranged up and down on the left, LEDs 97 are arranged up and down on the right, and a light guide panel 98 streakily guides rays of light of the left LEDs and rays of light of the right LEDs.

Subsequently, an outline of an operation to be performed by the displaying apparatus according to the present embodiment will be described. First, the image quality adjusting circuit 81 outputs RGB signals corresponding to an optimum image, by performing image quality adjusting to an input image signal (YPbPr signals) with use of the characteristic of the liquid crystal panel 87 and viewer's preference as parameters.

The timing controller 84 transfers, to the source driver 85 of the liquid crystal panel 87, gradation data which is obtained by converting the RGB signals into digital values indicating voltages, and also transfers, to the gate driver 86 thereof, a timing signal by which a scanning operation is performed at 60 Hz. Thus, the source electrodes and the gate electrodes of the liquid crystal panel 87 are driven respectively by the gate driver 86 and the source driver 85, and also not-illustrated common electrodes are driven together, whereby the image data is displayed on the screen of the liquid crystal panel.

Subsequently, an operation of the backlight module in the displaying apparatus according to the present embodiment will be described. That is, the timing controller 84 outputs the voltage values respectively corresponding to the first current setting value 91 and the second current setting value 92, by using an internal DA converter. For example, when the current values of the LEDs 96 and 97 at the time of the bright light emission are 20 mA, the first current setting value 91 is set to 2V. On the other hand, when the current values thereof at the time of the dark light emission are 4 mA, the second current setting value 92 is set to 0.4V.

The timing controller 84 outputs to the analog selector 93 a signal for switching between the first half and the second half within one frame period. Incidentally, the second half of the one frame period might be longer than the first half thereof. The analog selector 93 switches between the first current setting value 91 and the second current setting value 92 and outputs the switched value, in response to the signal input from the timing controller 84. Here, the first current setting value 91 is output in the first half, and the second current setting value 92 is output in the second half.

The timing controller 84 controls the scanning operation to the analog switch array 94. Here, it should be noted that the scanning operation is the operation which controls to shift the operation of switching ON to OFF from the upper analog switch to the lower analog switch in sequence, on the basis of the output value of the analog selector 93. Further, the timing controller 84 controls to make the time for maintaining each analog switch with ON different between the first light emission period and the second light emission period. In other words, the ON time in the first light emission period is shortened, while the ON time in the second light emission period is prolonged.

Each current setting value which has been ON/OFF controlled by the analog switch array 94 is converted into a current value (20 mA or 4 mA) by the LED driver 95, and the converted current value is supplied to the left LED 96 and the right LED 97. Each of the left LED 96 and the right LED 97 to which the current was supplied emits bright light or dark light in accordance with the supplied current value (20 mA or 4 mA). Then, since the rays of light from the left LEDs 96 and the right LEDs 97 are guided by the light guide panel 98 lateral-streakily, the front surface of the light guide panel 98 lights up zonally. Thus, the liquid crystal panel 87 emits light in such a manner that the image on the panel is scanned by the backlight.

Figure 9A:
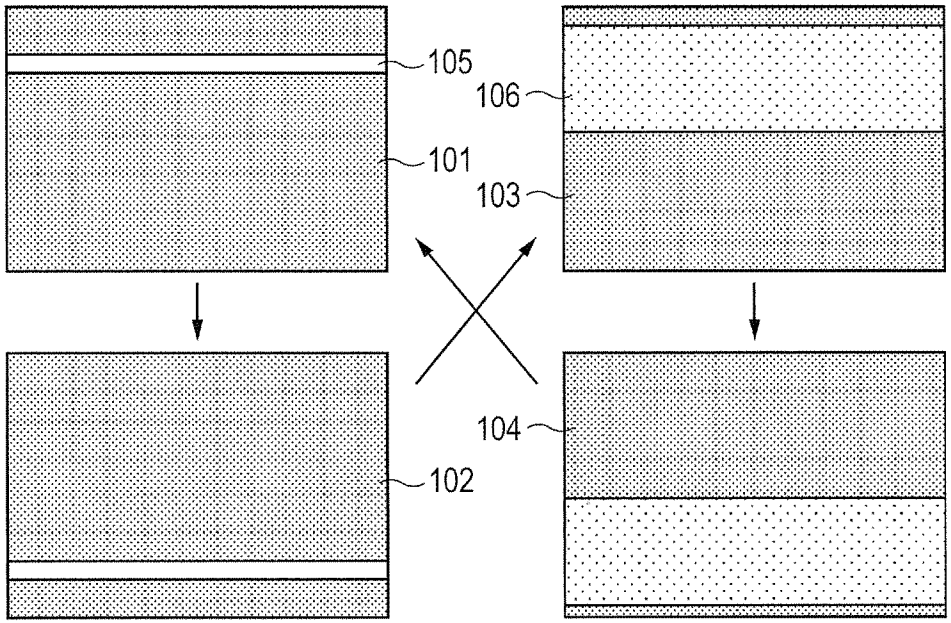
FIGS. 9A and 9B are diagrams illustrating light emission states of a backlight according to the fourth embodiment of the present invention.
Figure 9B:
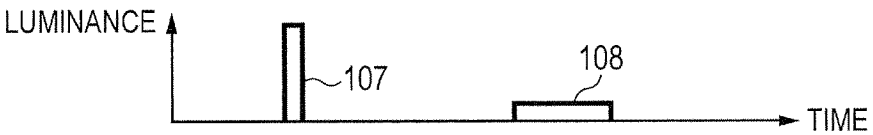

FIGS. 9A and 9B are diagrams illustrating light emission states of the backlight according to the present embodiment. More specifically, FIG. 9A shows a situation that the light emission state transitions as time passes, and FIG. 9B shows a relation between the time and the luminance on the line near the center.

In FIG. 9A, a state 101 is a backlight state in the first half of the first light emission period, a state 102 is a backlight state in the second half of the light emission period, a state 103 is a backlight state in the first half of the second light emission period, and a state 104 is a backlight state in the second half of the second light emission period. Light emission 105 is bright light emission for a short time, and light emission 106 is dark light emission for a long time. In FIG. 9B, a numeral 107 indicates a luminance change which occurs on the line near the center in the first light emission period, and a numeral 108 indicates a luminance change which occurs on the line near the center in the second light emission period.

In FIG. 9A, the backlight state repetitively transitions from the state 101 to the state 102, from the state 102 to the state 103, from the state 103 to the state 104, and from the state 104 to the state 101. At this time, the bright short-time light emission 105 performs the scan from top to bottom, the dark long-time light emission 106 subsequently performs the scan from top to bottom, and these operations are repeatedly performed. Incidentally, it should be noted that the light emission 105 corresponds to an example that light is emitted at first brightness for a first time, and the light emission 106 corresponds to an example that the light is emitted at second brightness darker than the first brightness for a second time longer than the first time.

Then, relations between the backlight states and the liquid crystal panel will be described hereinafter. Namely, the time of displaying for the first light emission period corresponds to the portion from the state just before the state 101 to the state just after the state 102, and the relevant time is equivalent to the time during which a bright thin line scans from top to bottom. Further, the time of displaying for the second light emission period corresponds to the portion from the state just before the state 106 to the state just after the state 107, and the relevant time is equivalent to the time during which a dark thick line scans from top to bottom.

If it pays attention to a certain line, as indicated by the numeral 107, it causes the backlight to emit light at high luminance for a short time in the first light emission period. On the other hand, as indicated by the numeral 108, it causes the backlight to emit light at low luminance for a long time in the second light emission period. In any case, the moving object as illustrated in FIG. 7E can be viewed by such light emission patterns of the backlight.

Figure 10:
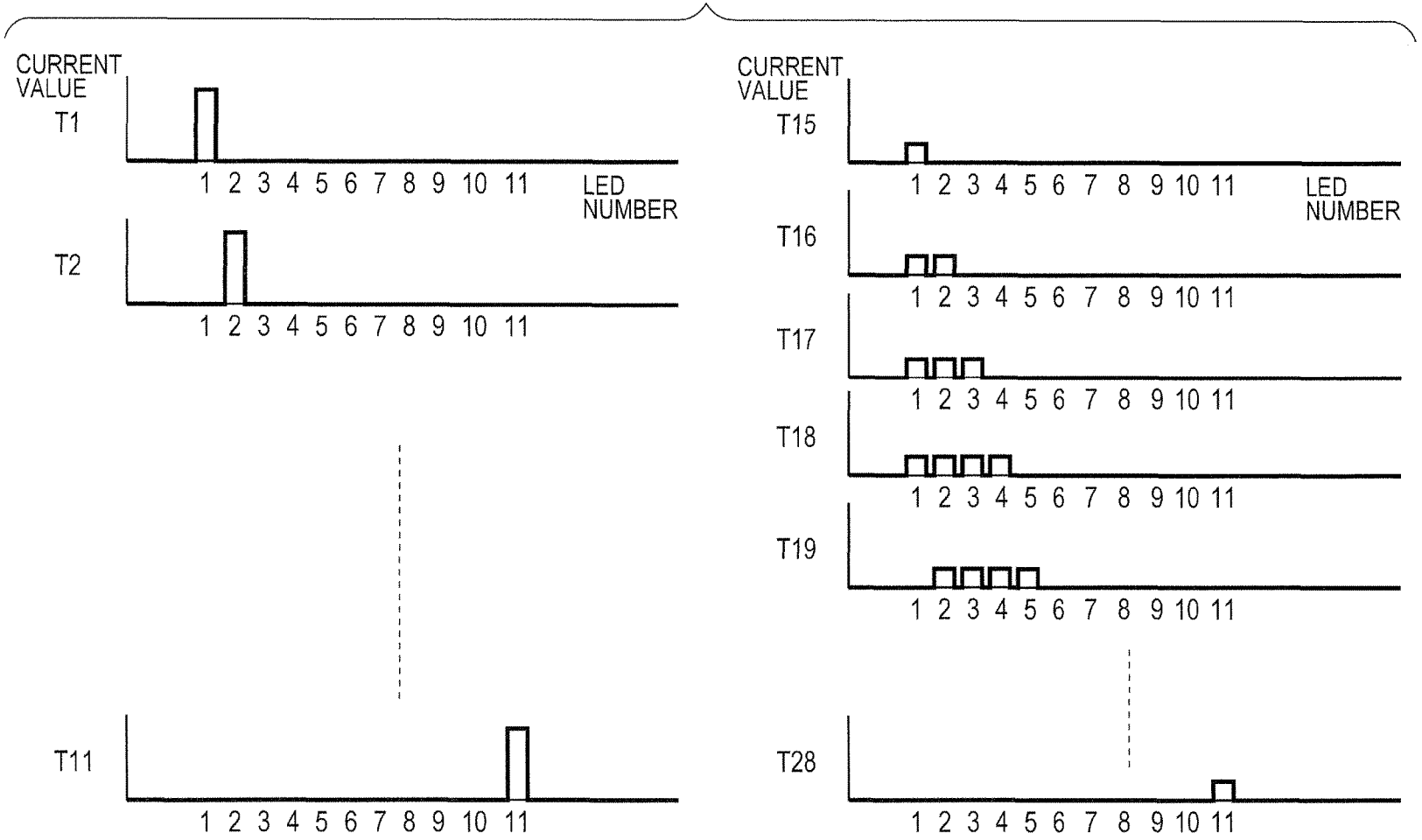
FIG. 10 is a diagram illustrating situations of currents flowing in an LED.

FIG. 10 is a diagram illustrating situations of the currents flowing in the LEDs 96 and 97. Here, it should be noted that the LED numbers of the LEDs 96 and 97 from top to bottom (from 1 to 11) are allocated on the horizontal axes in FIG. 10. Here, although the number of each set of the LEDs 96 and 97 is set to 11 for simplifying the description, the number of the LEDs can be made larger when the backlight having a large screen is used. Incidentally, the vertical axes indicate current values.

The currents flowing in the LEDs 96 and 97 transition from a state T1 to a state T32 in this order as time passes. In the states T1 to T32, the periods between the states T12 to T14 and between the states T29 to T32 not illustrated in FIG. 10 are pause periods respectively. If the image signal of 60 Hz is used, one period corresponds to 16.67 ms, and each state is about 0.505 ms. Incidentally, it should be noted that the first light emission period is the period between the states T1 to T11, and the second light emission period is the period between the states T15 to T28.

In the state T1, it is controlled to cause the uppermost LED (1) to emit light brightly. When the state transitions to the state T2, it is controlled to cause the LED (1) to turn off light and cause the LED (2) to emit light brightly. Then, the states sequentially transition from top to bottom so as to scan the screen, and it is controlled in the state T11 to cause the lowermost LED (11) to emit light. In the subsequent pause period, all the LEDs are being turned off.

In the state T15, it is controlled to cause the uppermost LED (1) to emit light darkly. When the state transitions to the state T16, it is controlled to cause the LED (2) to emit light darkly as controlling the LED (1) to emit light. Then, the states sequentially transition to the state T17 and further to the state T18 while increasing the number of the LEDs being emitting light. Then, in the state T19, it is controlled to cause the LED (1) to turn off light and cause the LED (5) to emit light darkly. Likewise, the state sequentially transitions to the state T20 and the subsequent states so as to cause the one LED to emit light and the one LED to turn off light in each state. After then, in the state T28, only the lowermost LED (11) is emitting light. In the subsequent pause period, all the LEDs are being turned off. Thus, it is possible by controlling the current values and the ON times of the LEDs to obtain the light emission patterns of the backlight as illustrated in FIGS. 9A and 9B.

Incidentally, it is necessary to set the center of the light emission period of the first light emission period and the center of the light emission period of the second light emission period to be positioned substantially symmetrical in the period of 16.67 ms. This is because, if such positions shift from each other, the component of 60 Hz cannot be canceled completely, whereby a flicker occurs.

In the present embodiment, the center of the light emission period of the first light emission period corresponds to the state T6, and the center of the light emission period of the second light emission period corresponds to the state T22. The difference between the center of the first-time light emission period and the center of the second-time light emission period corresponds to 16 transitions and is about 8.08 ms, and the difference between the center of the second-time light emission period and the center of the first-time light emission period in the next frame corresponds to 17 transitions and is about 8.59 ms. If a time subtraction of the centers corresponds to a difference of about several percent to ten or more percent, the flicker is nearly imperceptible. Therefore, as a countermeasure for the flicker, it only has to set these centers to be substantially symmetrical, but it is not necessary to set them to be accurately symmetrical.

It should be noted that the present invention is not limited to the above embodiment, and can be established in another embodiment of which the factors are the same as those of the above embodiment. For example, it is desirable from the aspect of the flicker to set the luminance of the first light emission period and the luminance of the second light emission period to be the same. Here, it should be noted that the luminance in this case implies a luminance value (integrated value) which is obtained by integrating pulse-like repetitive light emissions by a long time.

With respect to the range in which a light emission intensity of the LED is proportional to the current value, the luminance of the first light emission period and the luminance of the second light emission period come to be approximately the same if the current value for the second light emission period in the fourth embodiment is changed from 4 mA to 5 mA. Alternatively, the luminance of the first light emission period and the luminance of the second light emission period come to be the same if a light emission time of the first light emission period is set to be five times as much as a light emission time of the second light emission period.

"luminance of first light emission period":"luminance of second light emission period"=1:1

However, it is desirable to lower the luminance of the second light emission period within the flicker acceptable range, because the trail is reduced in this range. Although such a luminance ratio as described above changes according to display luminance, it roughly satisfies the following range.

"luminance of first light emission period":"luminance of second light emission period"=1:1→4:1

Namely, the luminance of the second light emission period is more than a quarter of the luminance of the first light emission period.

Further, since a cost of the LED increases if it causes the LED to emit light brightly for a short time, it is desirable to lower the luminance of the first light emission period than the luminance of the second light emission period for the purpose of reducing the cost. Therefore, it is practical if the luminance ratio satisfies the following range.

"luminance of first light emission period":"luminance of second light emission period"=1:1→1:2

Namely, the luminance of the second light emission period is twice or less as much as the luminance of the first light emission period.

Next, the number of the light emissions in the second light emission period need not be the same as the number of the light emission in the first light emission period. In the present embodiment, the object which is moving is blurred in the second light emission period. Therefore, even if the light emission is performed twice or more in the second light emission period every time the light emission is performed once in the first light emission period, any feeling of strangeness by which the object is viewed doubly or trebly is not provided.

Next, with respect to the backlight, the scanning manner which is performed by the LEDs arranged right and left is described in the fourth embodiment. However, it is of course possible to use a scanning manner which is performed by a direct-beneath LED backlight. Here, if the direct-beneath LED backlight is used, since it is possible to change a luminance distribution of the image data by independently controlling each LED block according to the luminance distribution of the image, whereby a dynamic contrast improves. In this case, both the light emission intensity for the first light emission period and the light emission intensity for the second light emission period are controlled for each LED.

Incidentally, the present invention is not limited to the above scanning manner. That is, the present invention is also applicable to, as well as the scanning manner, a manner of causing the whole surface of the backlight to simultaneously emit light by simultaneously blinking the whole surface. In case of applying the present invention to this manner, it only has to control, as well as the first embodiment, the light quantity and the time for causing the whole surface of the backlight to emit light. More specifically, it causes the whole surface to emit light brightly for a short time in the first light emission period, and to emit light darkly for a long time in the second light emission period.

Fifth Embodiment

Subsequently, the fifth embodiment of the present invention will be described. In the fifth embodiment, it will be described an operation of causing a device such as an LED for performing intermittent light emission to emit light for the second light emission period with a small duty cycle. Incidentally, the constitution of a displaying apparatus according to the fifth embodiment is the same as that of the displaying apparatus according to the fourth embodiment illustrated in FIG. 8. Hereinafter, only points different from the fourth embodiment will be described.

Figure 11A:
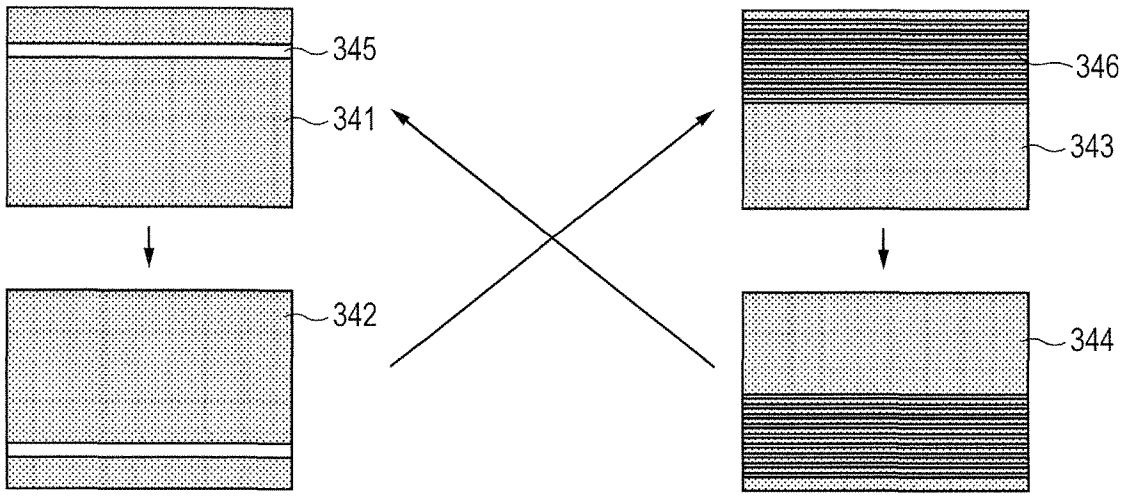
FIGS. 11A, 11B and 11C are diagrams for describing a backlight scanning operation according to a fifth embodiment of the present invention.
Figure 11B:
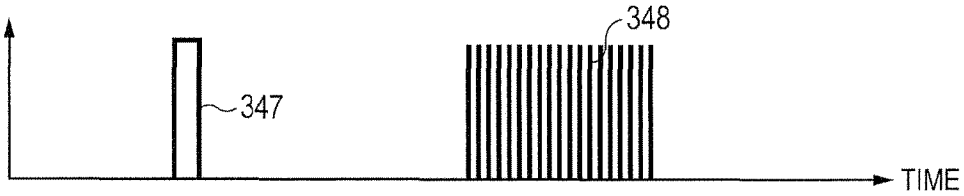
Figure 11C:
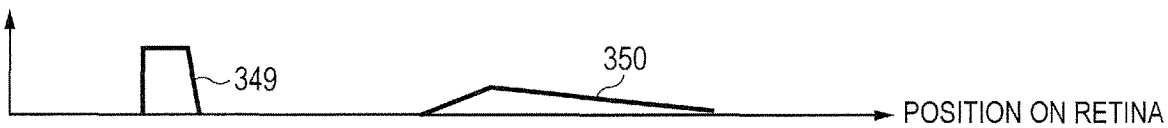

FIGS. 11A to 11C are diagrams for describing a backlight scanning operation according to the fifth embodiment of the present invention. More specifically, FIG. 11A shows a situation that the light emission state transitions as time passes, FIG. 11B shows a relation between the time and the luminance on the line near the center, and FIG. 11C shows a relation between a position on a viewer's retina and brightness viewed.

In FIG. 11A, a state 341 is a backlight state of the first half in the first light emission period, a state 342 is a backlight state of the second half in the first light emission period, a state 343 is a backlight state of the first half in the second light emission period, and a state 344 is a backlight state of the second half in the second light emission period. Light emission 345 is bright light emission for a short time, and light emission 346 is bright numerous light emissions. In FIG. 11B, a numeral 347 indicates a luminance change which occurs on the line near the center in the first light emission period, and a numeral 348 indicates a luminance change which occurs on the line near the center in the second light emission period. In FIG. 11C, numeral 349 indicates a distribution of projected brightness on a retina in the first light emission period, and numeral 350 indicates a distribution of projected brightness on a retina in the second light emission period.

In FIG. 11A, the backlight state repetitively transitions from the state 341 to the state 342, from the state 342 to the state 343, from the state 343 to the state 344, and from the state 344 to the state 341. At this time, the bright short-time light emission 345 performs the scan from top to bottom, and subsequently the bright numerous light emissions 346 perform the scan from top to bottom.

Then, relations between the backlight states and the liquid crystal panel will be described hereinafter. Namely, the first light emission period corresponds to the period from the state just before the state 341 to the state just after the state 342, and the relevant period is equivalent to the period during which a bright thin line scans from top to bottom. Further, the second light emission period corresponds to the period from the state just before the state 346 to the state just after the state 347, and the relevant period is equivalent to the period during which a plurality of bright thin lines scan from top to bottom.

If it pays attention to a certain line, as indicated by the numeral 347, it causes the backlight to emit light at high luminance for a short time in the first light emission period. Meanwhile, it causes the backlight to emit light at the same luminance numerous times for a very short time in the second light emission period. When a viewer follows with his/her eyes an object which is moving right and left, the pixel of the object on the liquid crystal panel 87 is viewed as if the pixel is flowing on the viewer's retina. When the light emission is impulse light emission such as the light emission 345, the pixel flashes for only a moment. Thus, the pixel is viewed only at the position on the viewer's retina at which this pixel at this time is reflected, as indicated by the distribution 349. When the light emission is plural-time light emissions such as the bright numerous light emissions 346, there are the plurality of the positions of the pixels at this time, the pixels are averaged and thus viewed so as to be spread as indicated by the distribution 350.

In any case, the moving object as illustrated in FIG. 7E can be viewed by combining such light emission patterns of the backlight with the displaying states on the liquid crystal panel 87 in the first light emission period and the second light emission period.

In the fifth embodiment, it is possible, without controlling a light emission intensity of the LED, to achieve the same effect by extremely reducing a duty cycle of the light emission in the second light emission period, even if performing a control only in a time direction. Likewise, even if it causes the backlight to emit light intermittently with a high duty cycle for the first light emission period, it is possible to achieve the same effect as that in the fourth embodiment because the displayed image is averaged visually.

Sixth Embodiment

Subsequently, the sixth embodiment of the present invention will be described. In the sixth embodiment, a case of changing brightness of a backlight as time passes will be described. Incidentally, the constitution of a displaying apparatus according to the sixth embodiment is the same as that of the displaying apparatus according to the fourth embodiment illustrated in FIG. 8. Hereinafter, only points different from the fourth embodiment will be described.

Figure 12:
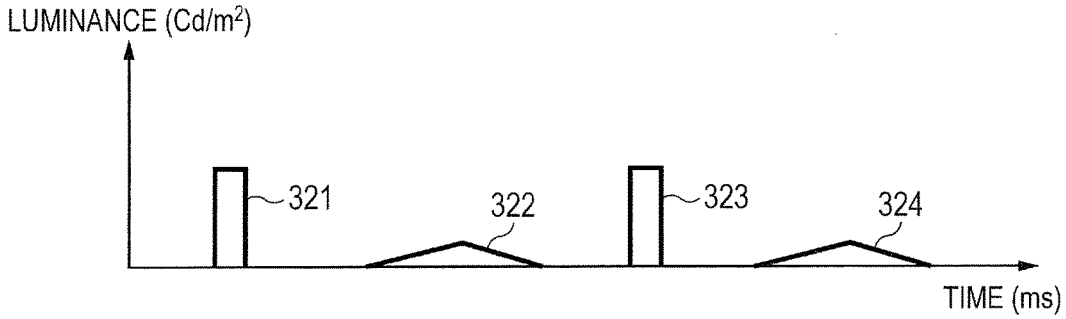
FIG. 12 is a diagram for describing an operation in which bright short-time light emission and dark light emission continuously changing are combined, according to a sixth embodiment of the present invention.

FIG. 12 is a diagram for describing an operation in which bright short-time light emission and dark light emission continuously changing are combined with each other, according to the sixth embodiment of the present invention. In FIG. 12, the horizontal axis indicates the passage of time, and the vertical axis indicates the luminance.

In FIG. 12, numeral 321 indicates bright short-time light emission in the first frame, numeral 322 indicates changing dark long-time light emission in the first frame, numeral 323 indicates bright short-time light emission in the second frame, and numeral 324 indicates changing dark long-time light emission in the second frame.

In the sixth embodiment, the dark light emission is made like a triangular pulse as indicated by the light emissions 322 and 324. Since a luminance component located at the intermediate position between the bright light emissions 321 and 323 produces a significant effect for preventing occurrence of a flicker, the occurrence of the flicker is prevented by increasing the relevant luminance. Besides, a density of a trail can be reduced by reducing the luminance at the periphery of the light emission 323. However, if the shape of the triangular pulse is made too abrupt, a moving image becomes double, whereby it is necessary to provide a sufficiently long period for the bright light emission 321. Incidentally, the light emission which can be continuously changed is not limited to the dark long-time light emission. Namely, also the bright short-time light emission may be continuously changed.

Figure 13:
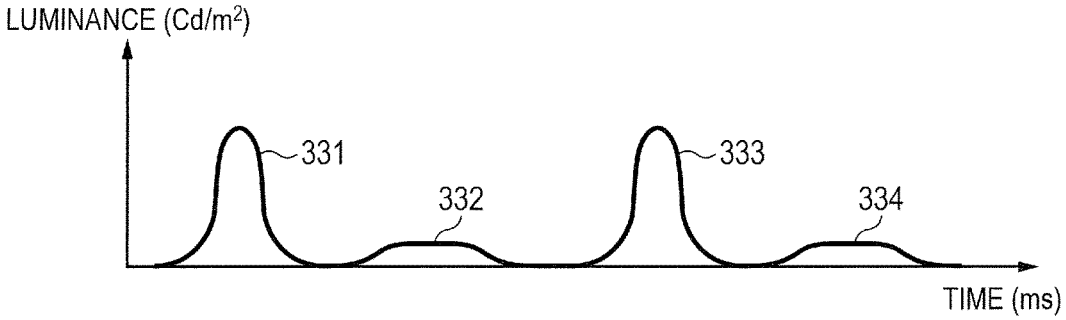
FIG. 13 is a diagram for describing an operation in which bright short-time light emission continuously changing and dark long-time light emission continuously changing are combined, according to the sixth embodiment of the present invention.

FIG. 13 is a diagram for describing an operation in which bright short-time light emission continuously changing and dark long-time light emission continuously changing are combined with each other, according to the sixth embodiment of the present invention. In FIG. 13, the horizontal axis indicates the passage of time, and the vertical axis indicates the luminance.

In FIG. 13, numeral 331 indicates bright short-time light emission continuously changing in the first frame, numeral 332 indicates dark long-time light emission continuously changing in the first frame, numeral 333 indicates bright short-time light emission continuously changing in the second frame, and numeral 334 indicates dark long-time light emission continuously changing in the second frame.

In the present embodiment, both the bright light emission and the dark light emission are continuously changed. Namely, if the light emission is continuously changed, a change of the current flowing in an LED becomes gradual, whereby it is possible to reduce a load to a power source. In particular, when the whole surface is controlled, it is possible to reduce costs for the power source circuit.

Even when the light emission is continuously changed in this way, it is possible to obtain the image of an object which is substantially the same as that obtained when the light emission is not changed, and is close to the shape 723 illustrated in FIG. 7E, by shortening the bright light emission time as indicated by the numeral 331 and prolonging the dark light emission time as indicated by the numeral 332.

In the above embodiments, it is possible to display the flicker-free image which has less double blurring even if the intermediate image data which costs to display the moving image and to which the viewer feels a sense of interference is not used. As just described, since the intermediate image data is not used, it is possible to perform a high-quality image display. Further, since the viewing state in which the dark elliptic image is linked to the bright spherical image is natural for the viewer as to how the moving image is viewed, this state does not provide a feeling of strangeness to the viewer.

Incidentally, it should be noted that the present invention can be widely used to a display such as a television receiver, a tuner-separated monitor, a PC monitor or the like in which a backlight is used.

Other Embodiments

Aspects of the present invention can also be realized by a computer of a system or an apparatus (or a device such as a CPU or an MPU) that reads out and executes a program recorded on a memory device to perform the functions of the above-described embodiments, and by a method, the steps of which are performed by a computer of a system or an apparatus by, for example, reading out and executing a program recorded on a memory device to perform the functions of the above-described embodiments. For this purpose, the program is provided to the computer for example via a network or from a recording medium of various types serving as the memory device (e.g., a computer-readable medium).

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-050586 filed Mar. 7, 2012 and Japanese Patent Application No. 2012-050792 filed Mar. 7, 2012 which are hereby incorporated by reference herein in their entirety.

What is claimed is:

1. A backlight controlling apparatus which controls a backlight in a displaying apparatus for displaying image frames based on image data at a display frame rate which is double an input frame rate, comprising:

an input unit configured to input original image data of the input frame rate;

a generating unit configured to generate intermediate image data corresponding to an intermediate image frame based on the original image data;

a determining unit configured to determine a light emission period and a light emission intensity for causing the backlight to emit light in accordance with whether the displaying apparatus displays an original image frame based on the original image data or the intermediate image frame based on the intermediate image data generated by the generating unit based on the original image data such that (i) a first light emission period of the backlight for displaying the original image frame based on the original image data is shorter than a second light emission period of the backlight for displaying the intermediate image frame based on the intermediate image data, (ii) a first light emission intensity of the backlight for displaying the original image frame based on the original image data is higher than a second light emission intensity of the backlight for displaying the intermediate image frame based on the intermediate image data, and (iii) a first integrated value defined based on integrating the first light emission intensity by the first light emission period is approximately equal to a second integrated value defined based on integrating the second light emission intensity by the second light emission period; and a controlling unit configured to, in a case where the displaying apparatus displays image frames at the display frame rate which is double the input frame rate of the original image data, perform control to cause the backlight to emit light at the first light emission intensity for the first light emission period for displaying the original image frame based on the original image data on the displaying apparatus, and cause the backlight to emit light at the second light emission intensity for the second light emission period for displaying the intermediate image frame based on the intermediate image data generated by the generating unit based on the original image data on the displaying apparatus.

2. The backlight controlling apparatus according to claim 1, wherein the controlling unit controls the backlight in a scanning manner.

3. The backlight controlling apparatus according to claim 1, wherein the controlling unit independently controls each block in the backlight of a direct-beneath type.

4. The backlight controlling apparatus according to claim 1, wherein the controlling unit simultaneously blinks a whole surface of the backlight.

5. The backlight controlling apparatus according to claim 1, wherein the controlling unit performs the control to cause the backlight to intermittently emit light at least either at a time when emitting light at the first light emission intensity or at a time when emitting light at the second light emission intensity.

6. The backlight controlling apparatus according to claim 1, further comprising a display controlling unit configured to display the original image frame based on the original image data and the intermediate image frame based on the intermediate image data so that a gradation of the intermediate image data is lower than a gradation of the original image data, wherein the controlling unit causes the backlight to emit light in an even light quantity.

7. A backlight controlling method which is performed by a backlight controlling apparatus which controls a backlight in a displaying apparatus for displaying image frames based on image data at a display frame rate which is double an input frame rate, comprising:

inputting original image data of the input frame rate;

generating intermediate image data corresponding to an intermediate image frame based on the original image data;

determining a light emission period and a light emission intensity for causing the backlight to emit light in accordance with whether the displaying apparatus displays an original image frame based on the original image data or the generated intermediate image frame based on the intermediate image data generated based on the original image data such that (i) a first light emission period of the backlight for displaying the original image frame based on the original image data is shorter than a second light emission period of the backlight for displaying the intermediate image frame based on the intermediate image data, (ii) a first light emission intensity of the backlight for displaying the original image frame based on the original image data is higher than a second light emission intensity of the backlight for displaying the intermediate image frame based on the intermediate image data, and (iii) a first integrated value defined based on integrating the first light emission intensity by the first light emission period is approximately equal to a second integrated value defined based on integrating the second light emission intensity by the second light emission period; and in a case where the displaying apparatus displays image frames at the display frame rate which is double the input frame rate of the original image data, performing control to cause the backlight to emit light at the first light emission intensity for the first light emission period for displaying the original image frame based on the original image data on the displaying apparatus, and cause the backlight to emit light at the second light emission intensity for the second light emission period for displaying the intermediate image frame based on the intermediate image data generated based on the original image data on the displaying apparatus.

8. A computer-readable storage medium storing a program for causing a computer to perform a backlight controlling method which is performed by a backlight controlling apparatus which controls a backlight in a displaying apparatus for displaying image frames based on image data at a display frame rate which is double an input frame rate, wherein the program causes the computer to:

input original image data of the input frame rate;

generate intermediate image data corresponding to an intermediate image frame based on the original image data;

determine a light emission period and a light emission intensity for causing the backlight to emit light in accordance with whether the displaying apparatus displays an original image frame based on the original image data or the generated intermediate image frame based on the intermediate image data generated based on the original image data such that (i) a first light emission period of the backlight for displaying the original image frame based on the original image data is shorter than a second light emission period of the backlight for displaying the intermediate image frame based on the intermediate image data, (ii) a first light emission intensity of the backlight for displaying the original image frame based on the original image data is higher than a second light emission intensity of the backlight for displaying the intermediate image frame based on the intermediate image data, and (iii) a first luminance integrated value defined based on integrating the first light emission intensity by the first light emission period is approximately equal to a second integrated value defined based on integrating the second light emission intensity by the second light emission period; and in a case where the displaying apparatus displays image frames at the display frame rate which is double the input frame rate of the original image data, perform control to cause the backlight to emit light at the first light emission intensity for the first light emission period for displaying the original image frame based on the original image data on the displaying apparatus, and cause the backlight to emit light at the second light emission intensity for the second light emission period for displaying the intermediate image frame based on the intermediate image data generated based on the original image data on the displaying apparatus.

9. A backlight controlling apparatus which controls a backlight used in a displaying apparatus for displaying an image frame based on image data, comprising:

an input unit configured to input the image data; and a controlling unit configured to perform control to cause the backlight to emit light at a first light emission intensity L for a first time period, and cause the backlight to emit light continuously at a second light emission intensity M lower than the first light emission intensity L for a second time period longer than the first time period such that a first integrated value defined based on integrating the first light emission intensity L by the first time period is approximately equal to a second integrated value defined based on integrating the second light emission intensity M by the second time period, in a period for displaying one image frame based on the image data on the displaying apparatus, and perform control to cause the backlight not to emit light for a third time period between the first time period and the second time period.

10. The backlight controlling apparatus according to claim 9, wherein the backlight is caused to emit light twice or more at the second light emission intensity M every time the backlight is caused to emit light once at the first light emission intensity L.

11. The backlight controlling apparatus according to claim 9, wherein the controlling unit controls the backlight in a scanning manner.

12. The backlight controlling apparatus according to claim 9, wherein the controlling unit independently controls each block in the backlight of a direct-beneath type.

13. The backlight controlling apparatus according to claim 9, wherein the controlling unit simultaneously blinks a whole surface of the backlight.

14. The backlight controlling apparatus according to claim 9, wherein the controlling unit performs the control to cause the backlight to intermittently emit light at least either at a time when emitting light at the first light emission intensity L or at a time when emitting light at the second light emission intensity M.

15. The backlight controlling apparatus according to claim 9, wherein the controlling unit controls to continuously change luminance at least either at a time when emitting light at the first light emission intensity L or at a time when emitting light at the second light emission intensity M.

16. A backlight controlling method which is performed by a backlight controlling apparatus which controls a backlight used in a displaying apparatus for displaying an image frame based on image data, comprising:

inputting the image data; and performing control to cause the backlight to emit light at a first light emission intensity L for a first time period, and cause the backlight to emit light continuously at a second light emission intensity M lower than the first light emission intensity L for a second time period longer than the first time period such that a first integrated value defined based on integrating the first light emission intensity L by the first time period is approximately equal to a second integrated value defined based on integrating the second light emission intensity M by the second time period, in a period for displaying one image frame based on the image data on the displaying apparatus, and performing control to cause the backlight not to emit light for a third time between the first time period and the second time period.

17. A computer-readable storage medium storing a program for causing a computer to perform a backlight controlling method which is performed by a backlight controlling apparatus which controls a backlight used in a displaying apparatus for displaying an image frame based on input image data, wherein the program causes the computer to perform control to cause the backlight to emit light at a first light emission intensity L for a first time period, and cause the backlight to emit light continuously at a second light emission intensity M lower than the first light emission intensity L for a second time period longer than the first time period such that a first integrated value defined based on integrating the first light emission intensity L by the first time period is approximately equal to a second integrated value defined based on integrating the second light emission intensity M by the second time period, in a period for displaying one image frame based on the image data on the displaying apparatus, and to perform control to cause to backlight not to emit light for a third time period between the first time period and the second time period.

* * * * *